US011918122B2

(12) United States Patent
Gillstrom et al.

(10) Patent No.: US 11,918,122 B2
(45) Date of Patent: Mar. 5, 2024

(54) ADJUSTABLE CHAIR AND ASSOCIATED SYSTEMS, METHODS, DEVICES, AND SOFTWARE

(71) Applicant: STRÖM Ergonomics Corp., The Blue Mountains (CA)

(72) Inventors: Diana Gillstrom, Toronto (CA); Philip Michael Chang, Toronto (CA); Steven Yi, Toronto (CA)

(73) Assignee: STRÖM ERGONOMICS CORP., The Blue Mountains (CA)

( * ) Notice: Subject to any disclaimer, the term of this patent is extended or adjusted under 35 U.S.C. 154(b) by 0 days.

(21) Appl. No.: 18/257,960

(22) PCT Filed: Dec. 17, 2021

(86) PCT No.: PCT/IB2021/000887
§ 371 (c)(1),
(2) Date: Jun. 16, 2023

(87) PCT Pub. No.: WO2022/130020
PCT Pub. Date: Jun. 23, 2022

(65) Prior Publication Data

US 2023/0397741 A1 Dec. 14, 2023

Related U.S. Application Data

(60) Provisional application No. 63/127,733, filed on Dec. 18, 2020.

(51) Int. Cl.
*A47C 3/20* (2006.01)
*A47C 7/14* (2006.01)
(Continued)

(52) U.S. Cl.
CPC ..... *A47C 31/008* (2013.01); *A47C 3/20* (2013.01); *A47C 7/14* (2013.01); *A47C 7/462* (2013.01); *A47C 7/541* (2018.08)

(58) Field of Classification Search
CPC ..... A47C 31/008; A47C 3/20; A47C 7/541; A47C 7/462; A47C 7/14
See application file for complete search history.

(56) References Cited

U.S. PATENT DOCUMENTS 7,163,263 B1 1/2007 Kurrasch et al.
7,931,334 B1 * 4/2011 Caruso ..... A47C 7/467 297/217.3

(Continued)

FOREIGN PATENT DOCUMENTS

CA 3119569 A1 5/2020
DE 102018005144 A1 1/2019

OTHER PUBLICATIONS

International Application No. PCT/IB2021/000887, International Search Report, Written Opinion, 12 pages, dated May 9, 2022.

*Primary Examiner* — Rodney B White

(57) ABSTRACT

A method of controlling an adjustable chair comprising the steps of measuring the height of a person, entering the height of the person into a software application on a mobile device, taking a photograph of the person with a mobile device, analyzing the photograph to determine physical measurements of the person, storing the measurements in the mobile device; calculating optimum ergonomic adjustment of the chair based upon the stored measurements; and, transmitting signals to a controller in the chair to control actuators and adjust various components in the chair to achieve optimum ergonomic adjustment. The technology also includes the ergonomic task chair adjusted by the aforementioned method.

16 Claims, 45 Drawing Sheets

(51) Int. Cl.

| | |
|---|---|
| ***A47C 7/38*** | (2006.01) |
| ***A47C 7/46*** | (2006.01) |
| ***A47C 7/54*** | (2006.01) |
| ***A47C 31/00*** | (2006.01) |
| ***A47C 31/12*** | (2006.01) |

(56) References Cited

U.S. PATENT DOCUMENTS

| | | | | |
|---|---|---|---|---|
| 8,596,716 | B1 * | 12/2013 | Caruso | B60N 2/0228 297/217.3 |
| 9,943,174 | B1 * | 4/2018 | Jacobs | A61H 9/0078 |
| 10,085,562 | B1 * | 10/2018 | Labrosse | G05B 19/406 |
| 11,484,127 | B2 * | 11/2022 | Jacobs | A47C 7/705 |
| 2017/0105540 | A1 * | 4/2017 | Jacobs | A47C 4/06 |
| 2018/0084915 | A1 * | 3/2018 | Norman | A47C 5/04 |
| 2018/0271286 | A1 * | 9/2018 | Jacobs | A47C 7/723 |
| 2018/0271287 | A1 * | 9/2018 | Jacobs | A47C 1/124 |
| 2018/0317661 | A1 * | 11/2018 | Lutwak | A61H 1/0292 |
| 2020/0214456 | A1 * | 7/2020 | Jacobs | A47C 7/705 |
| 2021/0035580 | A1 * | 2/2021 | Hille | G06F 3/167 |
| 2022/0366758 | A1 * | 11/2022 | Schoonmaker | A47C 1/023 |

* cited by examiner

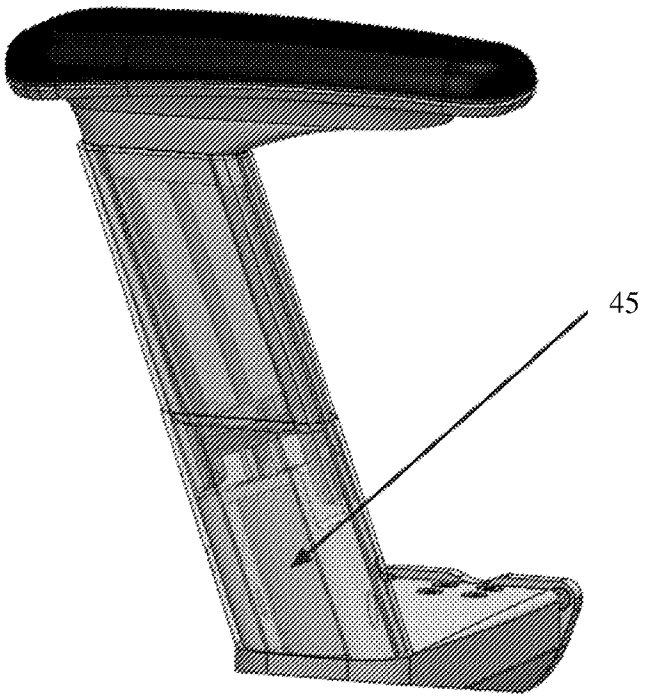
FIG. 26
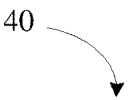

4000

ADJUSTABLE CHAIR AND ASSOCIATED SYSTEMS, METHODS, DEVICES, AND SOFTWARE

This application claims the benefit of and priority to U.S. Provisional Patent Application No. 63/127,733 entitled "PROGRAMMABLE AND REMOTELY CONTROLLED ERGONOMIC CHAIR AND A METHOD OF ADJUSTING THE SAME," filed on Dec. 18, 2020, which is hereby incorporated by reference in its entirety for all purposes.

TECHNICAL FIELD

The present technology relates generally to programmable chairs and the systems, methods, apparatuses, and software for controlling and adjusting an adjustable chair.

BACKGROUND

The ability to ergonomically adjust or position office or tasks chairs has become increasingly important as awareness grows of occupational injuries arising from prolonged sitting, particular when sitting in a chair which fails to provide adequate body support or which discourages users from sitting in a balanced position. While adjustable task or office chairs offer many ways to adjust the chair components, if a user does not understand the how or why of the various chair adjustments, this may result in a chair configuration which is poorly suited to the user in terms of providing adequate support and promoting a healthier sitting posture. Despite the growing awareness, users often have little understanding of how to adjust chairs beyond basic comfort preferences, and this can become problematic when a person is sitting for hours at a time on a daily basis. Prolonged sitting in poorly adjusted chairs can lead to a variety of health problems: poor posture, repetitive motion injuries, back pain, musculoskeletal disorders, etc. Ultimately, health issues may result in high costs to employers from absenteeism, lost productivity, and increased health care, disability, and worker's compensation costs. These injuries are, however, largely preventable by providing ergonomically designed workspaces and furniture.

Ergonomics is the study of the interaction between persons and their work environment, with an emphasis on improving worker efficiency, productivity, and health and safety. Ergonomically adjusted chairs can mitigate or eliminate fatigue, discomfort, and injury arising from being seated for hours at a time. To reduce the risk of injury and musculoskeletal disorders, it is important that office chairs and the like be adjusted to the most ergonomically correct position for each user.

A typical adjustable task or office chair can be manually adjusted in a number of ways. The user can adjust the height of the chair, the position and height of the arms, the position of a head rest, and the tension of the lumbar support, for example. Seat depth, seat tilt, lumbar support height, and the tilt of the backrest are also adjustable on many chairs. Some chairs include hydraulic or pneumatic actuators to adjust various parts of the chair, others use gears, levers, and mechanical means, while still others employ electric motors.

Despite the ability to adjust the various chair components, users tend to adjust their chairs according to perceived comfort which does not always correlate to optimum ergonomic positions which reduce the risk of injury. In some situations, users will sit in the chair "as is" or will adjust only the height because they do not know how to use the other chair adjustments. And even if users hire a kinesiologist or ergonomic specialist to adjust their chairs, chairs often move around within offices and are used by multiple people, resulting in the loss of chair adjustments for those users.

Overview

Technology for configuring an adjustable chair is disclosed herein that allows the chair to be adjusted in a way that is ergonomically optimized for a user. The chair, which has actuators for positioning various components of the chair, wirelessly communicates with a software application operating on a mobile device. The application is capable of receiving from the user information such as the user's body measurements and, optionally, other personal data. Based on this information, the application calculates ergonomically optimal adjustments for the chair by applying factors from several different fields of science related to the study of ergonomics. The application then transmits these adjustments to the chair which performs the adjustments.

In various implementations, a method of controlling an adjustable ergonomic chair includes the steps of measuring the height of a person; entering the height of the person into a software application on a mobile device; taking a photograph of the person; analyzing the photograph to estimate physical measurements of the person; storing the measurements in the mobile device; calculating optimum ergonomic adjustments of the chair based upon the measurements; and transmitting signals to a controller in the chair to control actuators and adjust various components in the chair to achieve optimum ergonomic adjustment.

In various implementations, the adjustable ergonomic chair includes a seat attached to a base, adjustable armrests, and an adjustable backrest. The chair also includes a motorized central actuator system which selects and adjust various chair components using a ball-shift coupling system. The chair also includes secondary actuators for adjusting various other chair components. The chair is capable of wirelessly communicating with an external computer from which it receives commands to operate the central and secondary actuators.

In various implementations, the method of controlling an adjustable ergonomic chair includes the steps of: measuring the height of a user; entering the height into a software application running on a mobile device; taking one or more photographs of the user; analyzing the photographs to determine physical measurements of the user; storing the measurements on the mobile device this information in the mobile device running the application; calculating the optimum ergonomic adjustments for the chair based on the user's physical measurements; and transmitting those adjustments to the chair which uses systems of actuators to adjust the chair components accordingly.

In various implementations, the software application for adjusting an adjustable ergonomic chair operates on a computing device capable of performing the steps of: enabling a user to take various photographs of himself or herself; displaying the photographs on the device so the user can indicate various personal body measurements graphically; calculating personal body dimensions by analyzing the photographs in view of the user's known height; and calculating ergonomically optimum chair adjustments based on factors from several different fields of science related to the study of ergonomics.

Implementations of the technology include adjustments of seat height, tilt, and depth; armrest height and width; backrest tilt and height (for lumbar support); and lumbar support density. An implementation determines the ergonomically optimal adjustments for an adjustable chair based on a particular user's body measurements and other characteristics. In various implementations, adjustments are transmitted to the chair wirelessly from a mobile device, such as a smartphone or tablet, although they could be transmitted by wired connection as well. In various implementations, the user can override the suggested settings if desired.

Various implementations also include a central server. The server is capable of storing recommended ergonomic chair settings based on physical characteristics of a user, which recommended settings may be updated and transmitted to mobile devices from time to time. Users have an option to share their personal data with the central server, and this data is then used to optimize settings. For example, anthropometric data which is collected and saved, and then used to improve ergonomic product design, includes (but is not limited to): date of birth, gender, height, weight, seated position preference, knee height, hip height, elbow height, lumbar curve height, hip breadth, shoulder breadth, seat width, seat depth, armrest width, armrest height, seat height, lumbar support height, lumbar support density, tilt angle, and a log of adjustment overrides by users.

BRIEF DESCRIPTION OF THE DRAWINGS

Various implementations are disclosed, by way of example only, with reference to the accompanying schematic drawings in which corresponding reference symbols indicate corresponding parts.

FIG. 26 illustrates an armrest assembly for adjusting armrest height in an implementation.

DETAILED DESCRIPTION

Figure 1:
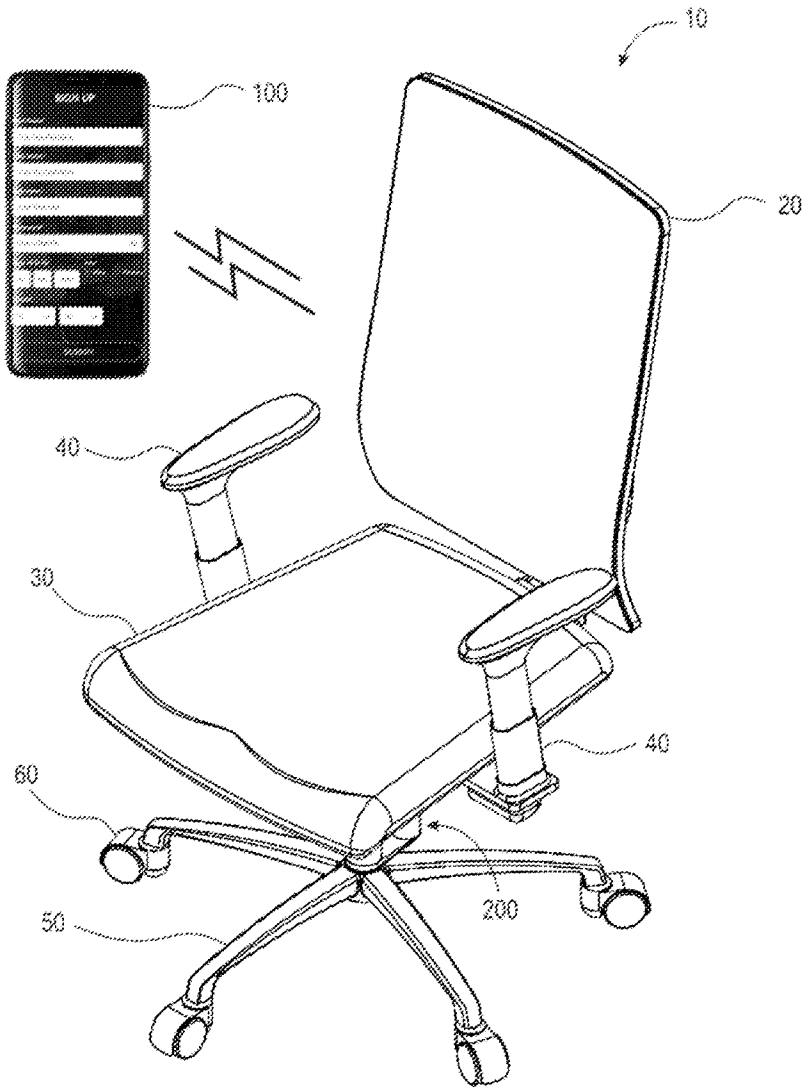
FIG. 1 illustrates a perspective view of a programmable ergonomic chair in an implementation.

While adjustable chairs provide many ways by which a user can configure the chair for optimal health and comfort, users are often unable to ergonomically configure their chairs because they do not know how to configure chairs for prolonged sitting according to their particular body characteristics. Various implementations are disclosed herein by which an adjustable chair is configured by a software application to be ergonomically optimized for a user based on the user's body measurements. An application operating on a computing device receives the user's body measurements and calculates ergonomically optimized chair adjustments based on those measurements using modern ergonomic methods, formulas, and other know-how. With ergonomically optimized settings determined, the computing device transmits the adjustments to the chair which has one or more motorized adjustment systems to perform the adjustments, thereby obtaining for the user an ergonomically-optimized chair. Thus, the technical effect of the technology is to bridge the gap between the user's inability to ergonomically configure his or her chair and obtaining an optimal ergonomic seating solution.

In an implementation, the user provides his or her body measurements to the application by using the computing device to take full-body photographs of the user, entering the user's height, and graphically designating body landmarks in the photographs. The application takes this information and interpolates a set of body measurements which it then uses to compute optimal ergonomic chair adjustments. The application, which is in wireless communication with the adjustable chair, then transmits the adjustment information to the chair so the adjustments can be performed.

In an implementation, an adjustable chair has a motorized adjustment system controlled by a microprocessor. The microprocessor communicates wirelessly with the software application running on a mobile device. The motorized adjustment system has one or more motors and gearing for adjusting the various components of the chair, such as seat height, armrest width, or lumbar depth, by adjusting the distances between the components. The microprocessor receives chair adjustment information transmitted by the application and commands with a motorized adjustment system to adjust the distances of the various components according to the information provided by the application.

It may be appreciated that, in implementations of the technology, certain parameters and characteristics of a user (a person intended to sit in the chair) are used to determine the most ergonomically correct position of the chair as follows.

Distance from top of user's head to floor: A method of the technology permits a user to measure his or her height and enter it into a software application on a mobile device. The method also prompts the user save one or more photos of himself or herself into memory or data storage on the mobile device. Then, through analysis of the image(s), parameters for adjusting various components of the chair are estimated. In other words, the user's known height may be used to scale a photograph of the user according to which other body measurements may be derived. These other measurements include the following.

Hip breadth: Maximum horizontal distance across the hips.

Shoulder breadth: Maximum horizontal breadth across the shoulders, measured to the protrusions of the deltoid muscles.

Elbow height: Vertical distance from the floor to the underside of the elbow.

Lumbar height: Vertical distance from the floor to the middle of lumbar curve (that is, the most pronounced part of the user's lordotic curve).

Hip height: Vertical distance from the floor to the greater trochanter (a bony prominence at the upper end of the thigh bone).

Knee or popliteal height: Vertical distance from the floor to the popliteal angle at the underside of the knee where the tendon of the biceps femoris muscle inserts into the lower leg.

Once the above-described measurements have been determined by digital analysis of the user's image, in combination with the known height of the user, the application determines optimum ergonomic chair settings as follows.

Seat height: Seat height is determined using base of knee height measurements along with small adjustments if sitting style is "perch," "recline," or "neutral" (refer to Table 1 below).

As seat height increases beyond knee height, pressure will be felt on the underside of the thighs which will cause reduced circulation, swollen feet, and considerable discomfort. As seat height decreases lower than back of the knee height, the user will flex the spine more into an exaggerated kyphotic ("hunched") posture and abandoning the lordotic curve in the lumbar spine which will cause additional stress on the tendons, ligaments, intervertebral discs, etc. Users will also experience greater problems rising from a seated position and require greater leg room. The optimal seat height for many purposes is close to the knee/popliteal height.

Seat depth: Seat depth=((hip height−knee height)+2.6" tissue allotment)−1" to avoid pressure on popliteal fossa.

If the seat depth is increased beyond the buttock-popliteal (back of the knee) length, the user will not be able to engage the backrest effectively without unacceptable pressure on the backs of the knees on the popliteal fossa, important nerves and vessels pass from the thigh to the leg by traversing through this fossa, resulting reduction of circulation to the lower extremities may lead to 'pins and needles,' swollen feet, and considerable discomfort. Furthermore, the deeper the seat, the greater the problems of standing up and sitting down.

Seat angle or tilt: A positive seat angle helps the user to maintain good contact with the backrest and helps to counteract any tendency to slide out of the seat. This is also helpful for users with a greater circumference in their abdominal area. Excessive tilt reduces hip/trunk angle and increases the difficulty of standing up and sitting down. For most purposes, a suitable solution falls between 5 and 10 degrees.

Armrest Width:

If hip breadth is larger than shoulder breadth, then armrest width=(hip measurement+2.6"). But if shoulder breadth is larger than hip breadth, then armrest width=shoulder breadth.

Further, seat width=armrest width.

If a seat is too wide, the user will typically lean to one side to engage the armrests which will distort their posture from a neutral position. If the seat is too narrow, the user will have unacceptable contact stress from the chair by placing pressure on the user's tissue which can result in pressure, bruising and skin breakdown.

Armrest height (from chair base or floor): Armrest height=(elbow height−hip height)+knee height.

Armrests should support the fleshy part of the forearm but should not engage the bony parts of the elbow where the highly sensitive ulnar nerve is near the surface as this may cause pain, numbness and tingling in the forearm and fingers. The proper use of armrests also helps offload pressure from low back because some of the force will be distributed through the armrests.

Backrest angle: As the backrest angle is decreased to less than 100 degrees, the user's weight is supported by his or her back muscles, and there is a greater amount of pressure on the ligaments, intervertebral discs. As the backrest angle increases to greater than 100 degrees, a greater proportion of the weight of the trunk is supported by the backrest—hence the compressive force between the trunk and pelvis is lessened. Increasing the angle between trunk and thighs improves lumbar lordosis, however, there will be an increase in the horizontal component of the compressive force. This will tend to drive the buttocks forward out of the seat unless counteracted by seat tilt, high friction upholstery or increased muscular effort. Increased backrest angle also leads to increased difficulty in the stand-up or sit-down action.

Lumbar support height (from base of chair or floor): Lumbar support height=(lumbar height−hip height)+knee height.

Lumbar support height may be controlled by adjusting the backrest height. The objective is to support the lumbar spine in its neutral position (lordotic or concave) without muscular effort, allowing the user to adopt a position that is physiologically acceptable and comfortably relaxed. Lumbar support will support the slight lordotic curve and ensure a neutral spine position allowing the muscles to relax and the vertebrae to maintain their shape without putting uneven pressure on the intervertebral discs which can lead to bulging or herniated discs, etc.

Center tilt: Chair positions may be adjusted according to the activity or seating position preference of the user: Recline=−5 to −10 degrees; Neutral=0 degrees; and Perch=+5 to +10 degrees. Seat height adjustments to compensate for changes in the center tilt angle ensure that the user's feet remain planted on the floor.

A seat that enables the user to adopt a semi-reclined position and has a lumbar support will minimize the mechanical loading on the lumbar spine and maximize the overall levels of reported comfort. A problem arises when tasks such as writing or drawing (which call for a forward leaning posture) as the benefit of the backrest support will be lost. This issue is improved through the "Center Tilt" feature which allows the backrest angle (between the seat pan and backrest) to remain at the 100-130 degrees, and the entire chair tilts forward as a unit. When engaging a center tilt, the chair height needs to adjust to a slightly higher position for a center tilt forward and a slightly lower position for a center tilt backward to ensure that the user's feet remain in contact with the floor.

TABLE 1

Change in Seat Height (mm) according to seat depth and seat angle

| | Seat Angle | | | | |
|---|---|---|---|---|---|
| Seat Depth (mm) | −10.0° | −5.0° | 0.0 | 5° | 10° |
| 400 | 35.00 | 19.00 | 0.00 | −19.00 | −35.00 |
| 410 | 36.00 | 19.00 | 0.00 | −19.00 | −36.00 |
| 425 | 38.00 | 20.00 | 0.00 | −20.00 | −38.00 |
| 435 | 38.00 | 20.00 | 0.00 | −20.00 | −38.00 |
| 440 | 39.00 | 20.00 | 0.00 | −20.00 | −39.00 |
| 450 | 40.00 | 21.00 | 0.00 | −21.00 | −40.00 |
| 460 | 41.00 | 22.00 | 0.00 | −22.00 | −41.00 |
| 465 | 41.00 | 22.00 | 0.00 | −22.00 | −41.00 |
| 475 | 42.00 | 22.00 | 0.00 | −22.00 | −42.00 |
| 480 | 43.00 | 23.00 | 0.00 | −23.00 | −43.00 |
| 490 | 44.00 | 23.00 | 0.00 | −23.00 | −44.00 |
| 500 | 45.00 | 24.00 | 0.00 | −24.00 | −45.00 |
| 520 | 45.00 | 24.00 | 0.00 | −24.00 | −45.00 |

As will be described in more detail infra, implementations of the present technology provide a method and apparatus which determine the most ergonomically correct position for an office chair and a means of adjusting various components of the chair remotely via a software application running on a mobile device, such as a smartphone or tablet computer. Moreover, anthropometric data regarding optimum ergonomic settings are saved in cloud storage so that software updates may be pushed out to mobile devices, to further enhance the accuracy of the measurements, and to improve future chair design. In other implementations, the mobile device communicates with the chair via Bluetooth® communication, although communication via near-field communication (NFC), wireless communication or even wired communication is contemplated and considered to be within the scope of the appended claims. The present technology offers an ergonomic solution for office chairs that can accommodate the 95th percentile of the global population.

In other implementations, the method and apparatus of the technology includes the capability of adjusting the following components of a typical task chair: seat height, seat depth, armrest width, armrest height, backrest or lumbar support height, lumbar support density or firmness, seat tilt angle, center tilt, and backrest angle. It may be appreciated that in an implementation of the technology other components of a chair may be adjusted. It may be further appreciated that in implementations of the technology, the user may override any suggested and calculated settings.

Turning now to the figures, FIG. 1 is a perspective view of one implementation of a programmable ergonomic chair 10. Programmable ergonomic chair 10 comprises a base 50 retaining a plurality of casters 60. Above the base is a seat adjustment assembly 200. Above seat adjustment assembly 200 is a seat 30. On the left and right sides of seat 30 are armrests 40. Affixed to the back side of seat 30 is backrest 20. Programmable ergonomic chair 10 is in wireless communication with mobile device 100.

In an implementation of programmable ergonomic chair 10, the chair actuations are controlled by a central actuation system and a system of secondary actuations. The central actuations are controlled via a single centralized motor with a single output shaft and ball-shift gearbox system. The ball-shift system of the central actuation system has multiple discrete positions; each position enables and disables a single or a combination of spur or bevel gears which in turn drive the desired seat actuation. The secondary actuations are operated via dedicated motors which can be turned on or off independently and operate separately from the central actuation mechanism.

An implementation of the motor of the central actuation system is a standard DC brushed motor coupled with a bespoke parallel output shaft gearbox. The output shaft of the gearbox is hollow, such that each gear coupled to it may be coupled and decoupled via a central ball-shift mechanism whose shaft runs through the center of the main hollow output shaft. Each actuation is selected via axial translation of the ball shifter relative to the hollow output shaft.

In an implementation of the technology, the central actuations include seat depth, seat tilt, seat height, and armrest width adjustments, while the secondary actuations include armrest height, backrest tilt, and backrest height. In an alternative implementation, backrest tilt is part of the central actuation system rather than a secondary actuation, and lumbar support density or firmness is an additional secondary actuation.

The central actuations are operated sequentially and engage a single gear at each stage. In an implementation of the technology, the seat height and the seat tilt are adjusted independently by dedicated actuated screw shafts and bevel gears. In an alternative implementation, simultaneous actuation of two screw shafts and bevel gears adjusts the seat height, and adjusting one screw shaft independent of the other screw shaft adjusts the seat tilt.

Other implementations of the technology include: battery power storage so that the chair can operate cordlessly, except perhaps during charging; a wireless communication protocol or chipset onboard that will enable communication to the user's interface (i.e., application) and/or the cloud for monitoring and data collection purposes; and nearly silent operation such that the user is not disturbed during actuations of the chair.

Figure 2:
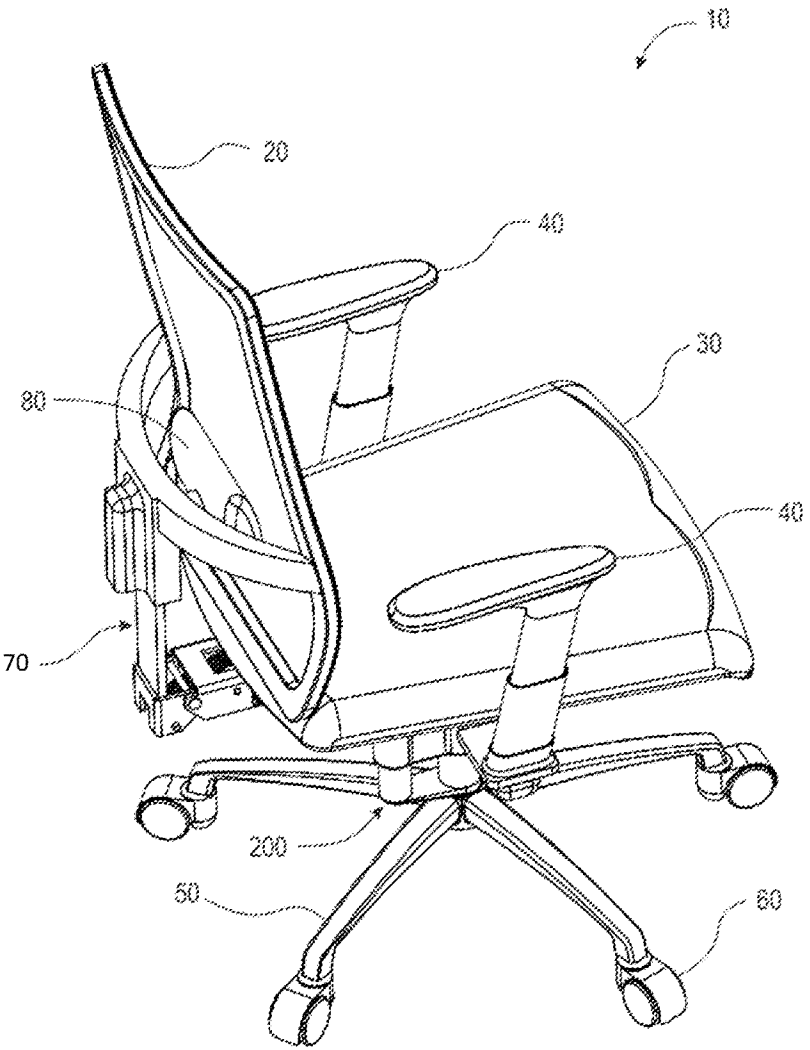
FIG. 2 illustrates a second perspective view of the programmable ergonomic chair shown in FIG. 1.

FIG. 2 is a second perspective view of programmable ergonomic chair 10 shown in FIG. 1. In this perspective, backrest 20 attaches to backrest adjustment assembly 70, which further comprises lumbar support 80.

Figure 3:
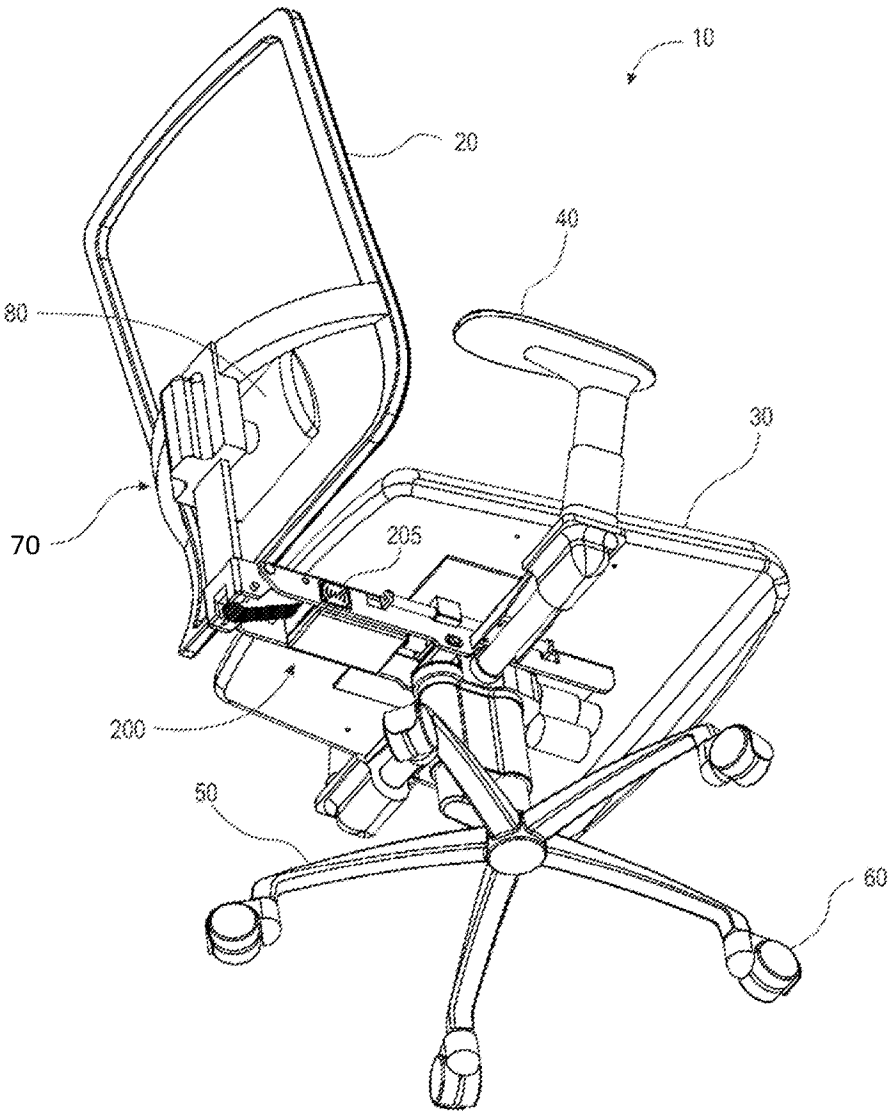
FIG. 3 illustrates a bottom rear perspective view of the programmable ergonomic chair shown in FIG. 1.

FIG. 3 is a bottom rear perspective view of programmable ergonomic chair 10 shown in FIG. 1. In this perspective, seat adjustment assembly 200 of programmable ergonomic chair 10 further comprises transceiver 205 for wireless communication with mobile device 100.

Figure 4:
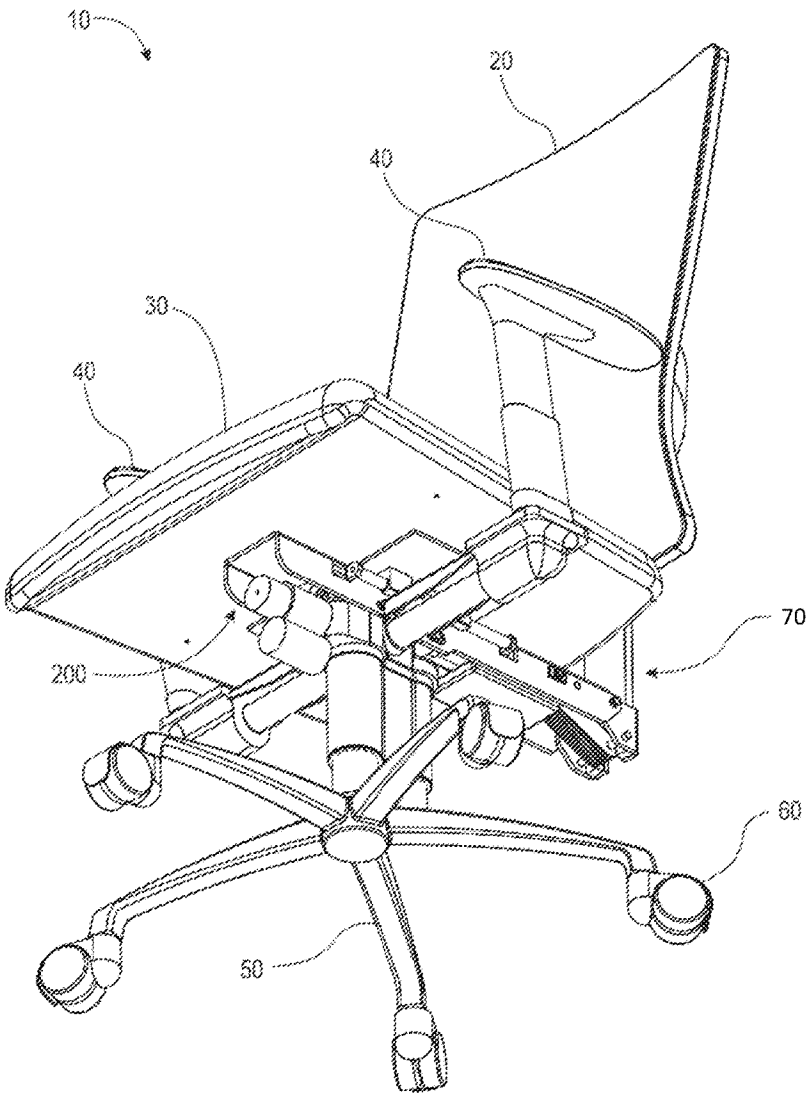
FIG. 4 illustrates a bottom front perspective view of the programmable ergonomic chair shown in FIG. 1.
Figure 5:
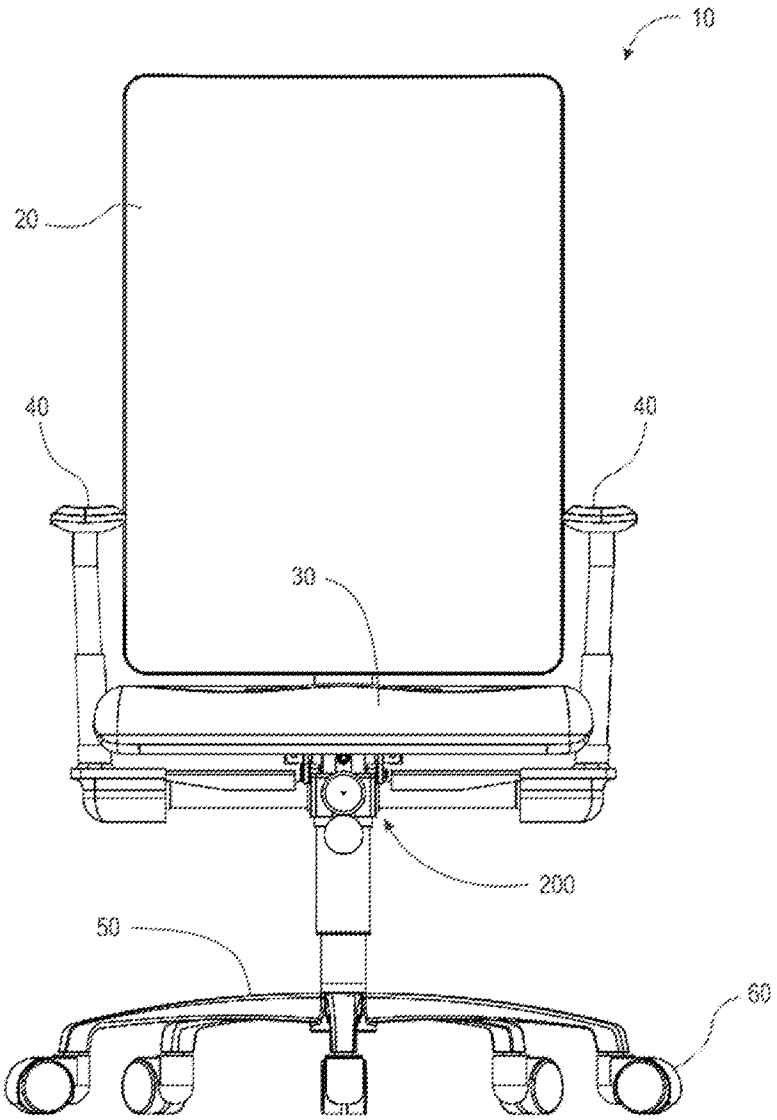
FIG. 5 illustrates a front elevational view of the programmable ergonomic chair shown in FIG. 1.
Figure 6:
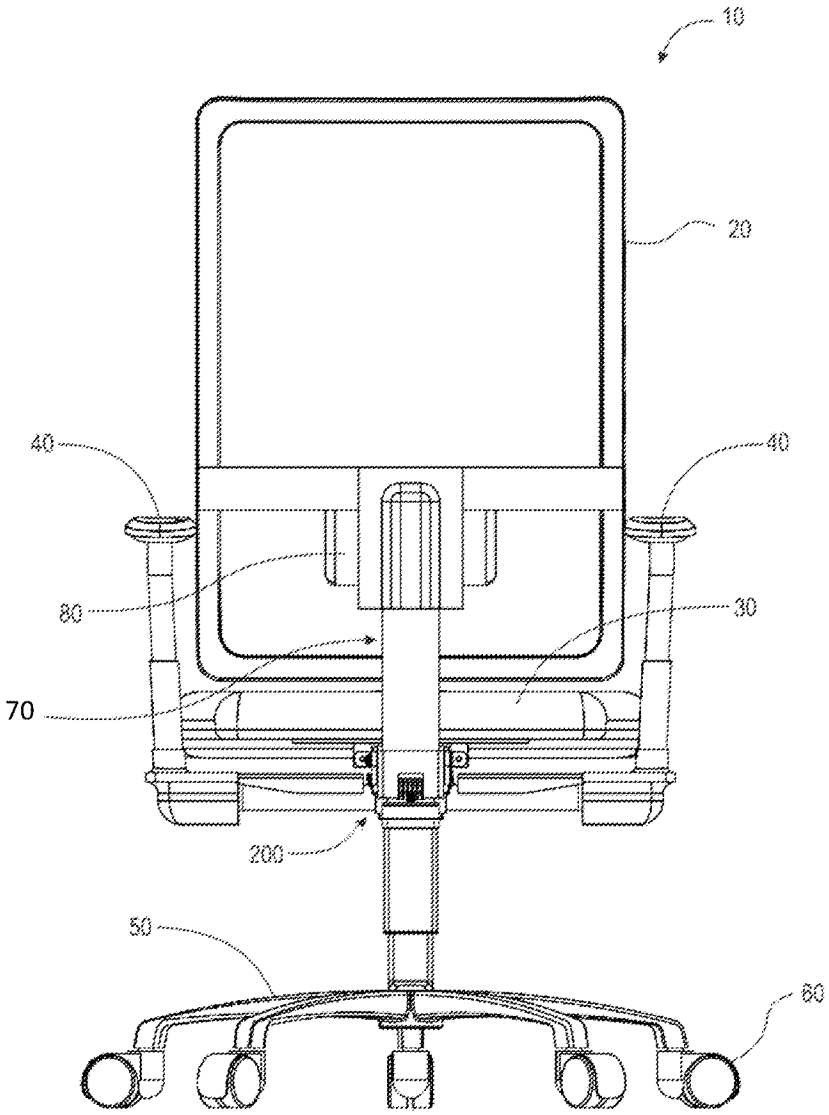
FIG. 6 illustrates a rear elevational view of the programmable ergonomic chair shown in FIG. 1.
Figure 7:
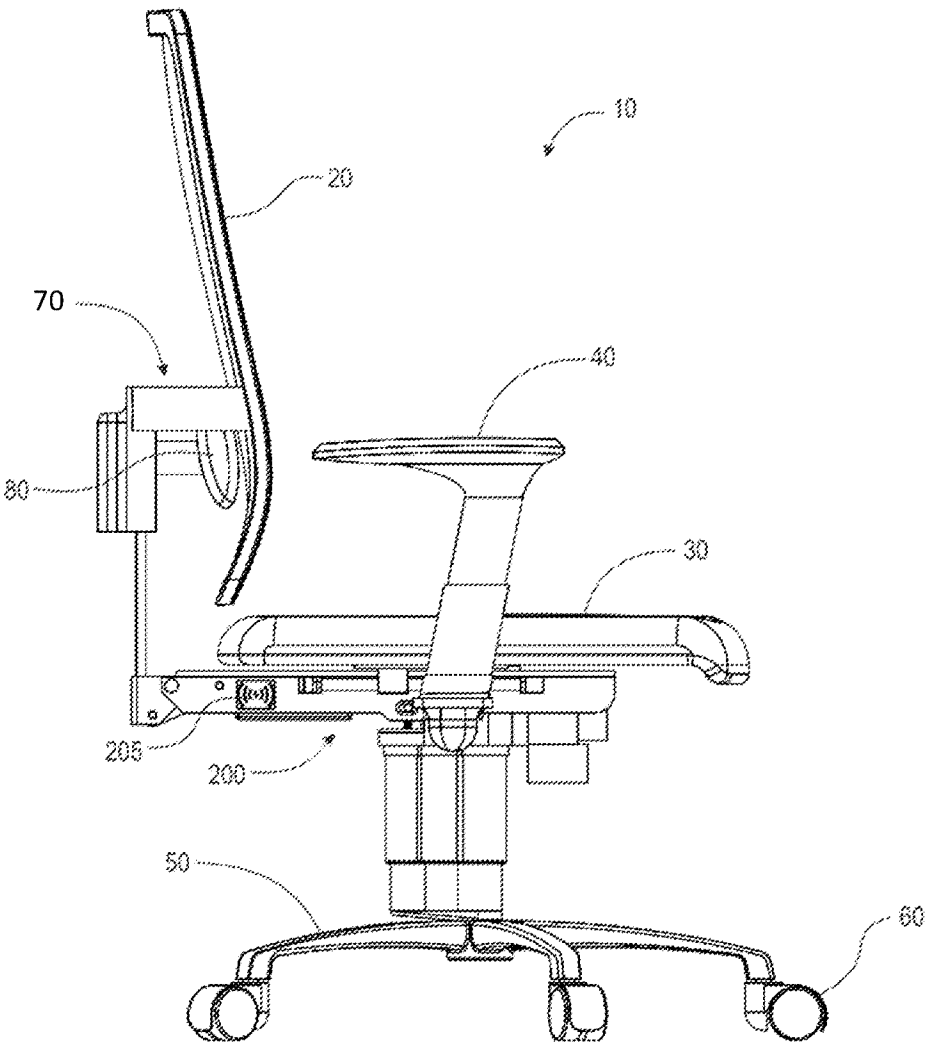
FIG. 7 illustrates a left elevational view of the programmable ergonomic chair shown in FIG. 1.
Figure 8:
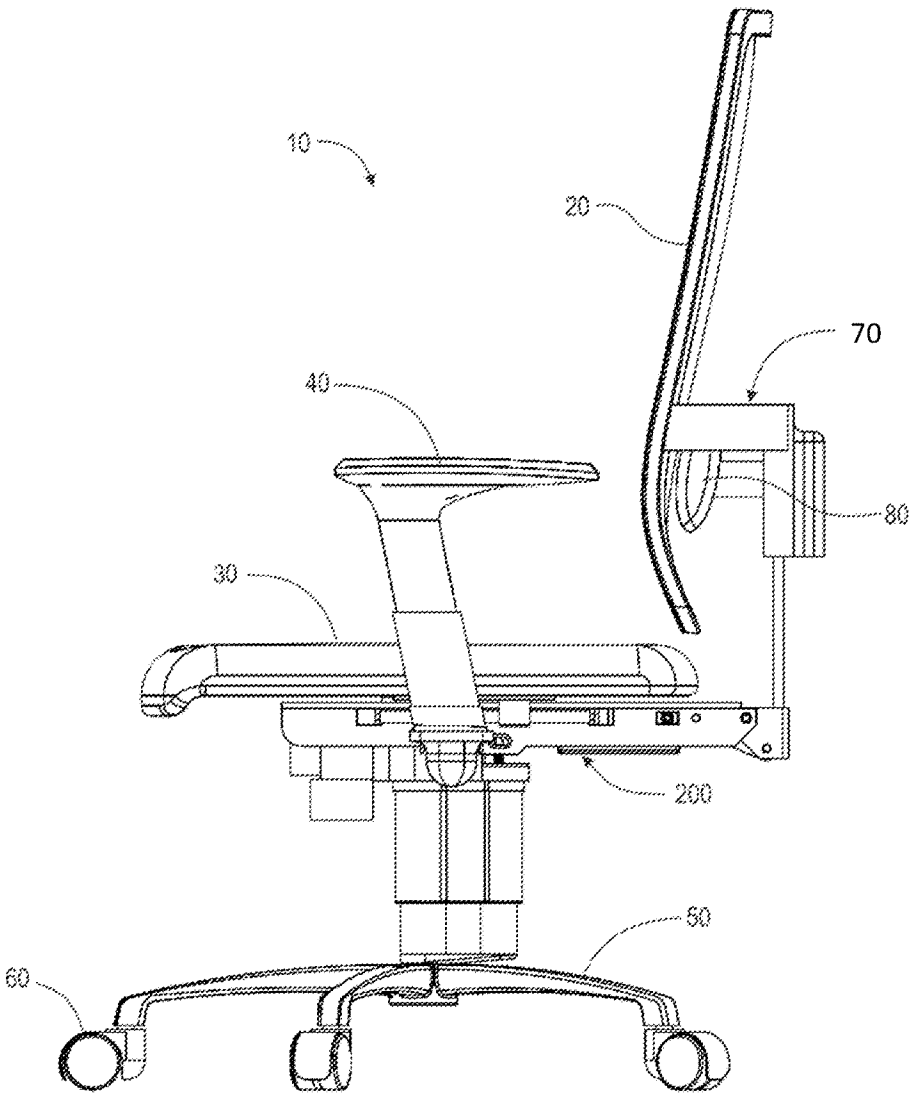
FIG. 8 illustrates a right elevational view of the programmable ergonomic chair shown in FIG. 1.
Figure 9:
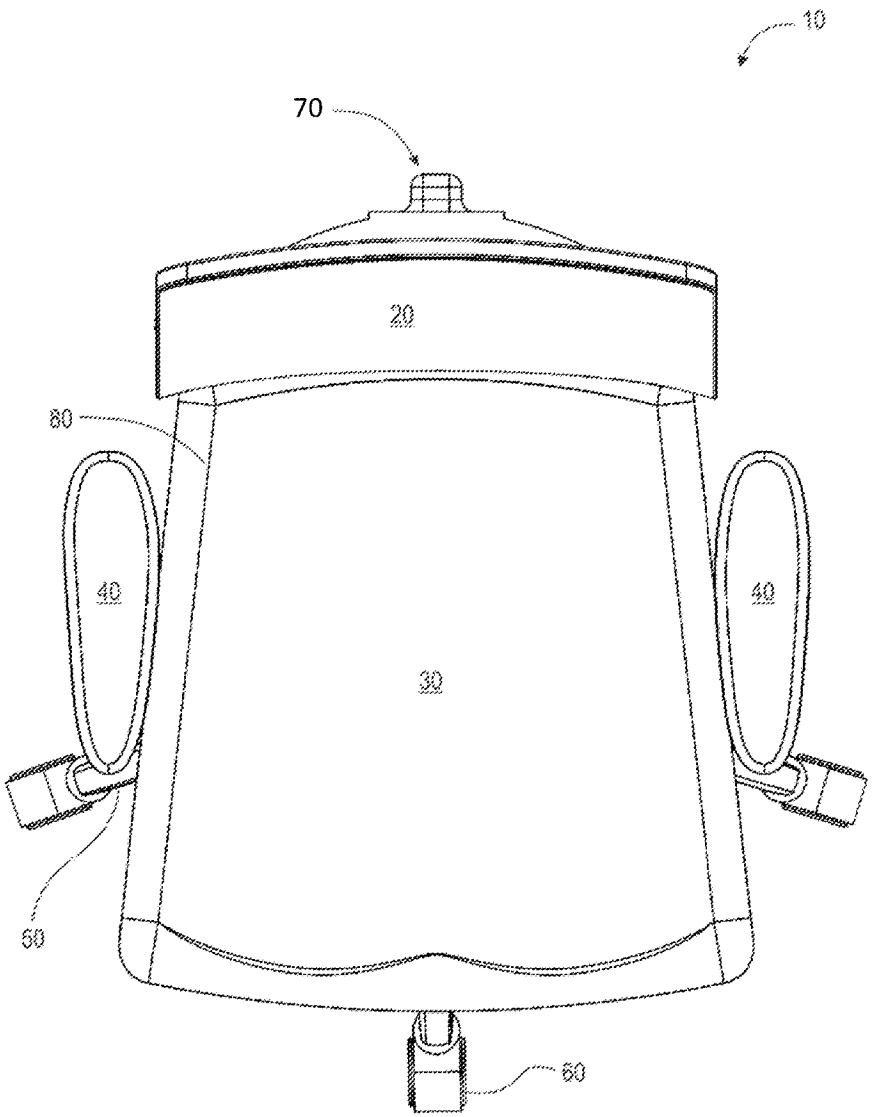
FIG. 9 illustrates a top view of the programmable ergonomic chair shown in FIG. 1.
Figure 10:
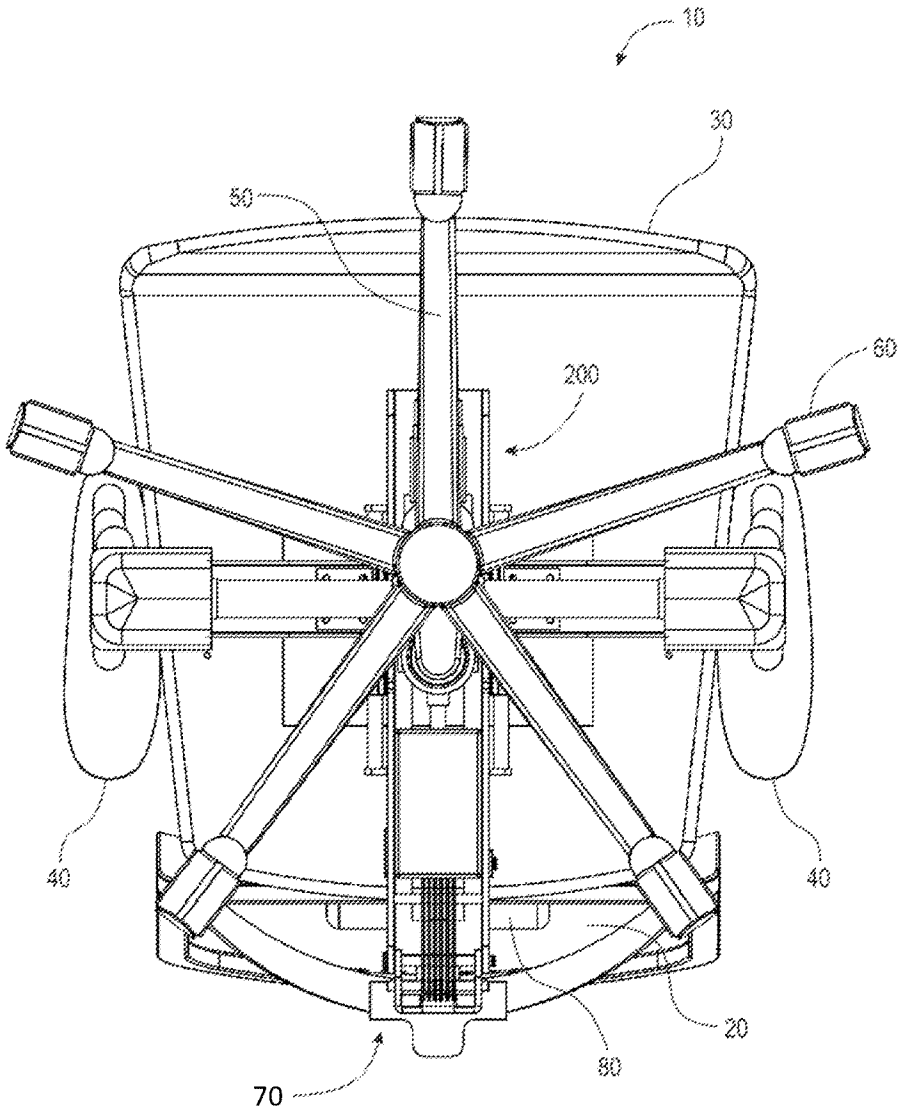
FIG. 10 illustrates a bottom view of the programmable ergonomic chair shown in FIG. 1.

FIG. 4 is a bottom front perspective view of the programmable ergonomic chair shown in FIG. 1. FIG. 5 is a front elevational view of programmable ergonomic chair 10 shown in FIG. 1. This is the view obtained by approaching the chair from the front. FIG. 6 is a rear elevational view of programmable ergonomic chair 10 shown in FIG. 1, as would be seen by approaching the rear of the chair. FIGS. 7 and 8 are, respectively, a left and right elevational view of programmable ergonomic chair 10 shown in FIG. 1. FIG. 9 is a top view of programmable ergonomic chair 10 shown in FIG. 1. This is a birds-eye view of the chair from above. FIG. 10 is a bottom view of programmable ergonomic chair 10 shown in FIG. 1. This view would be obtained by looking up from beneath programmable ergonomic chair 10.

Figure 11:
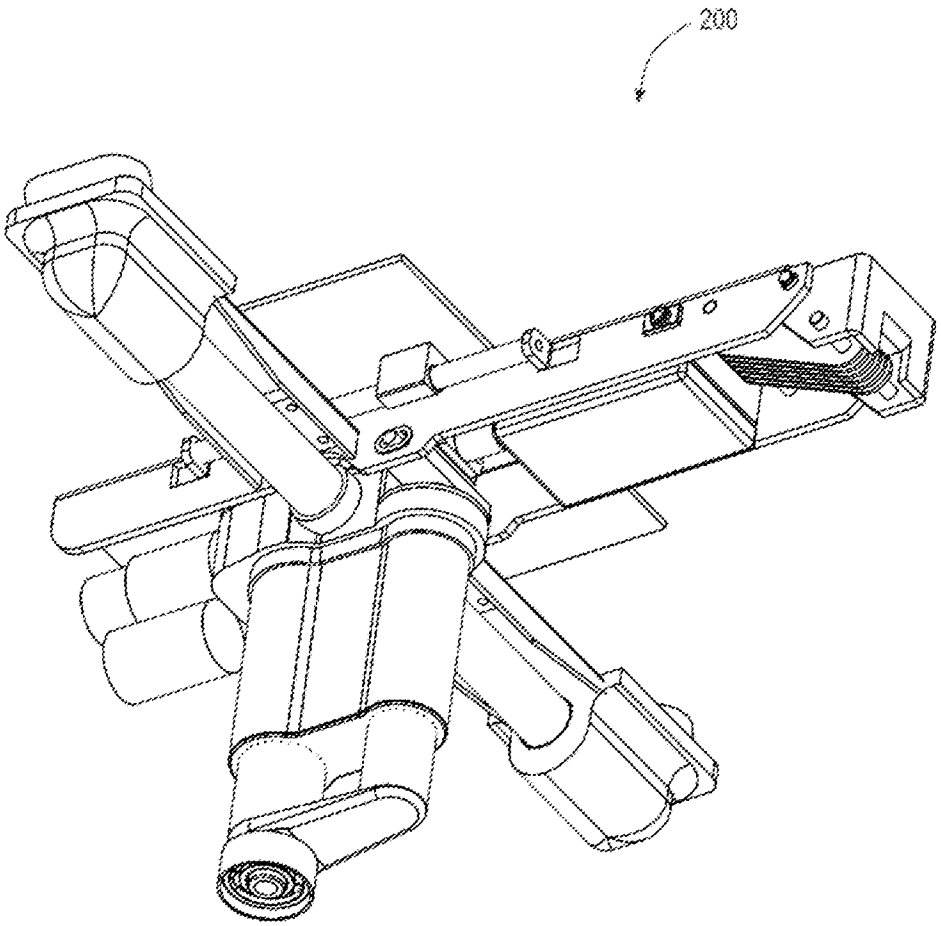
FIG. 11 illustrates a perspective view of the seat adjustment assembly of the programmable ergonomic chair shown in FIG. 1.

FIG. 11 illustrates a perspective view of seat adjustment assembly 200 of programmable ergonomic chair 10 shown in FIG. 1. This view obtains from looking up toward the underside of seat 30 but shows seat adjustment assembly 200 in isolation.

Figure 12:
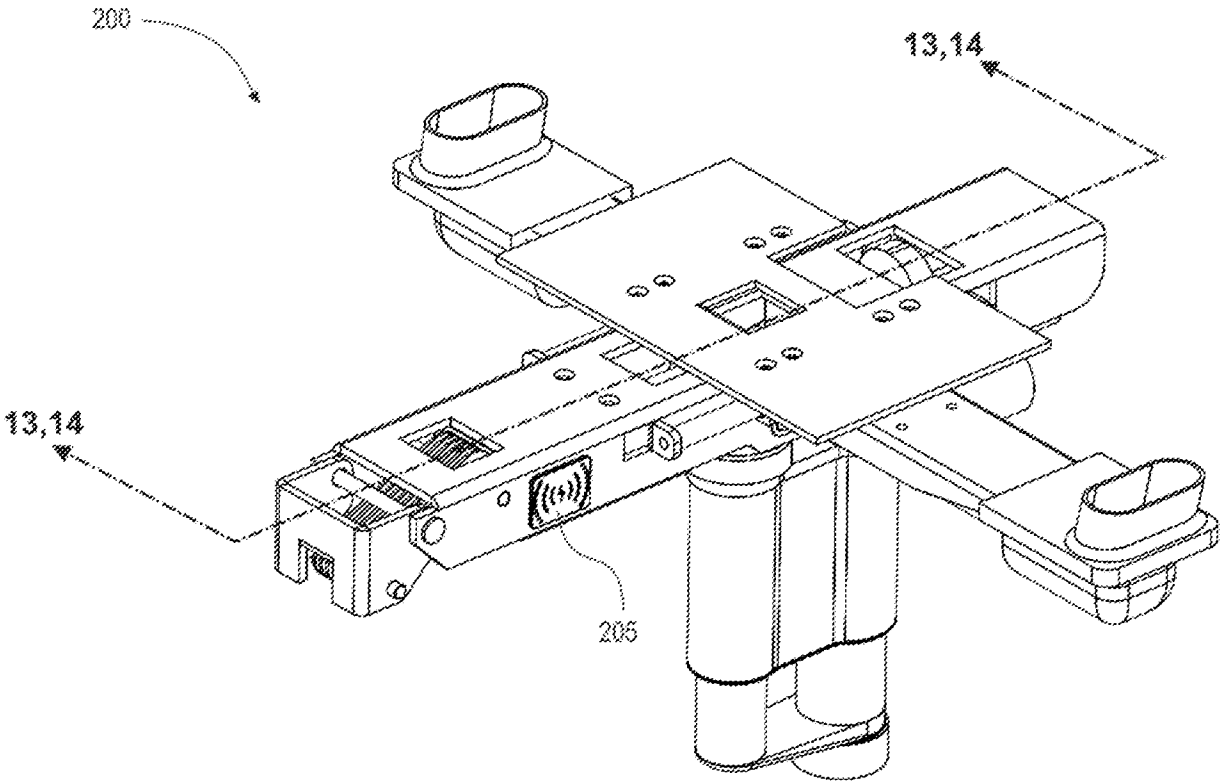
FIG. 12 illustrates a top perspective view of the seat adjustment assembly of the programmable ergonomic chair shown in FIG. 1.
Figure 14:
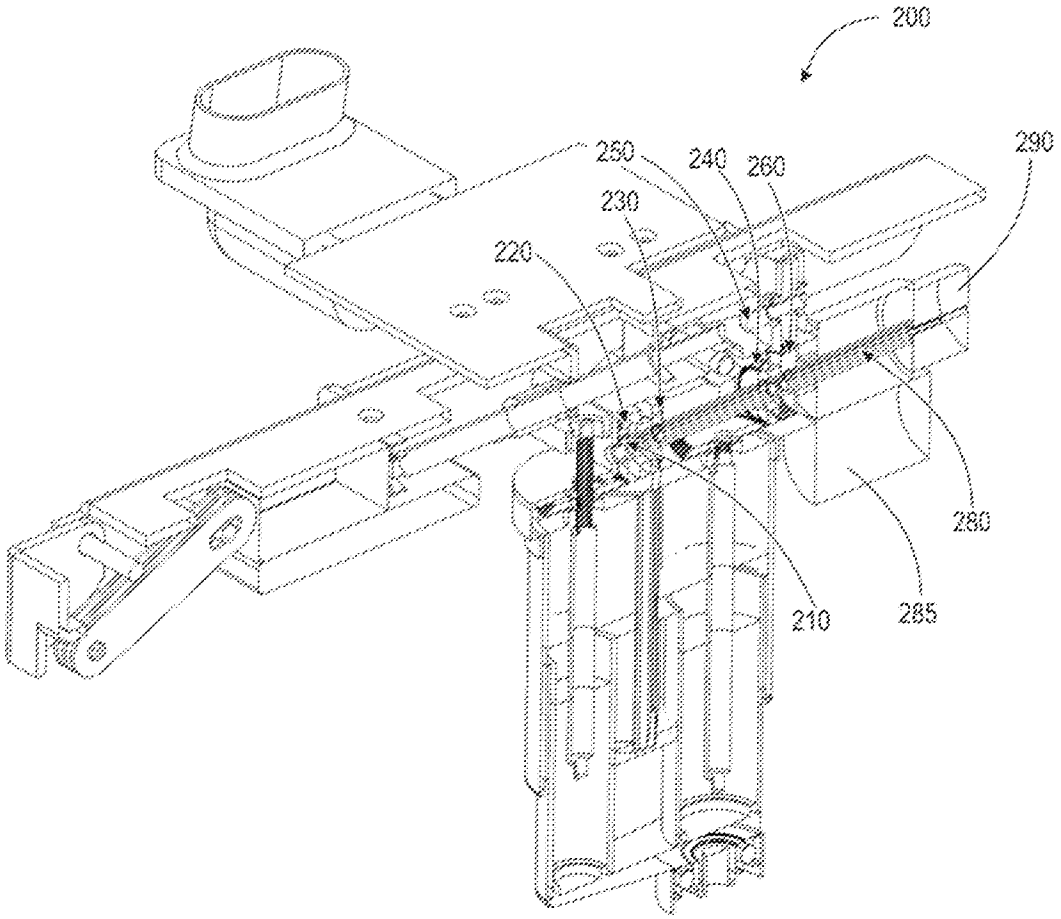
FIG. 14 illustrates a perspective cross-sectional view of the seat adjustment assembly of the programmable ergonomic chair, taken generally along line 14-14 in FIG. 12.
Figure 15:
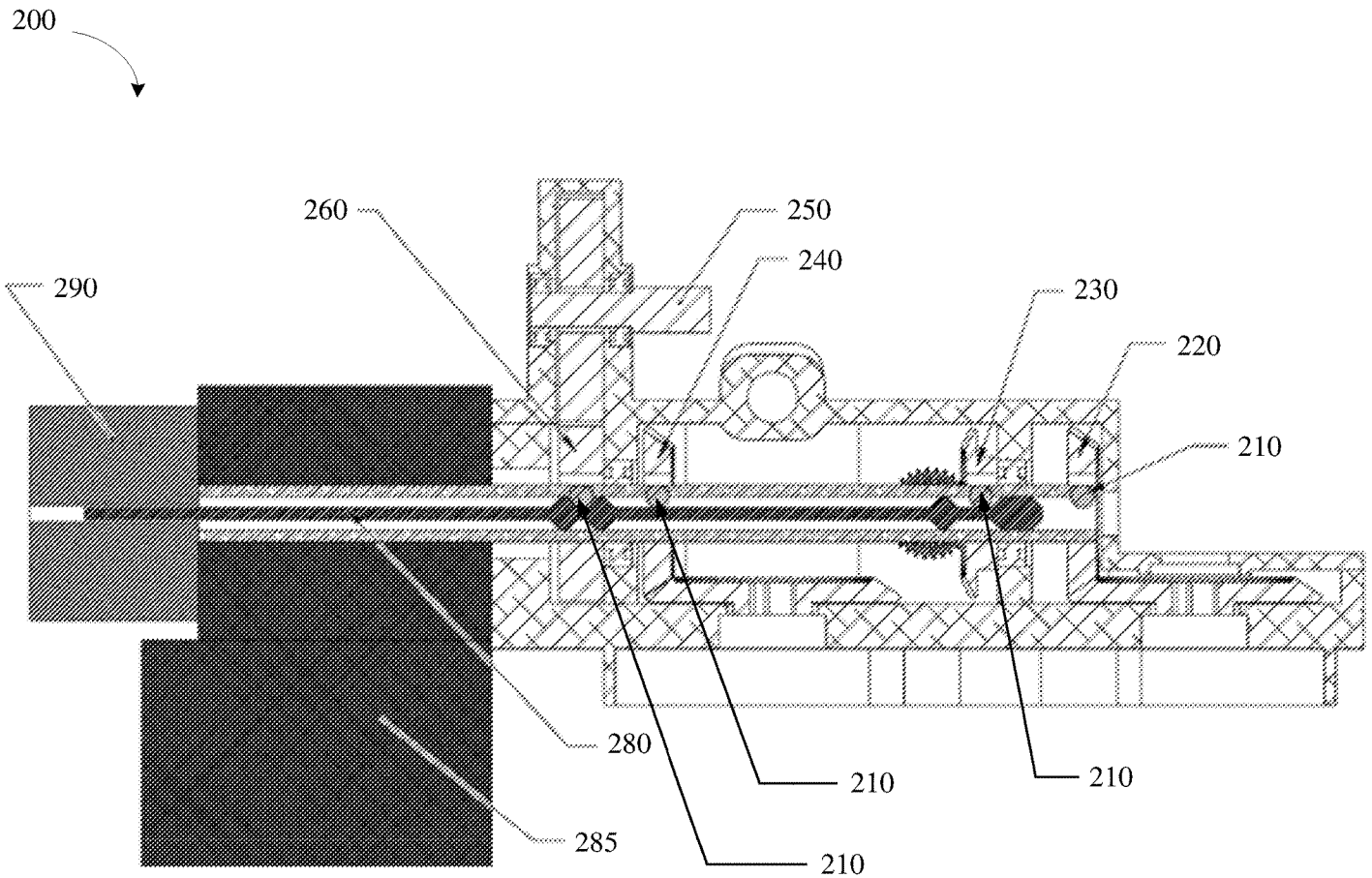
FIG. 15 illustrates a cross-sectional view of a ball-shift mechanism of a seat adjustment assembly in a neutral position in an implementation.

FIG. 12 illustrates a top perspective view of an implementation of seat adjustment assembly 200 of programmable ergonomic chair 10 shown in FIG. 1 with view lines 13-13 and 14-14 for the perspective views of FIGS. 14 and 15. This view would be obtained from looking downward on chair 10 with seat 30 removed, but with seat adjustment assembly 200 shown in isolation.

Figure 13:
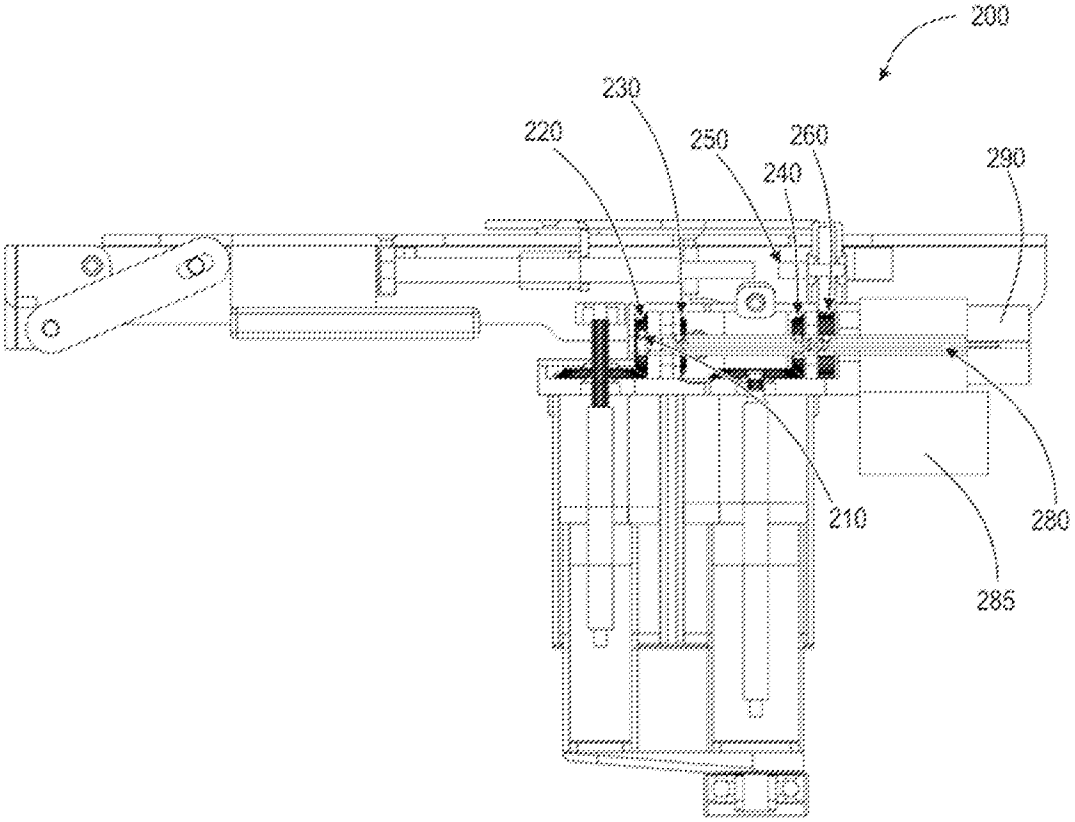
FIG. 13 illustrates a side cross-sectional view of the seat adjustment assembly of the programmable ergonomic chair, taken generally along line 13-13 in FIG. 12.

FIG. 13 is a side cross-sectional view of seat adjustment assembly 200 of programmable ergonomic chair 10, taken generally along line 13-13 in FIG. 12. In this view, a sliding ball shifter 280 is engaging secondary screw coupling gear 220 via ball coupler 210. Motor 285 drives the rotation of sliding ball shifter 280, which drives the rotation of secondary screw coupling gear 220, which in turn adjusts the tilt of seat 30 by raising or lower the secondary screw shaft. Also shown are other coupling gears which sliding ball shifter 280 can engage to make other chair adjustments. For example, motor 285 adjusts the width of the armrests of programmable ergonomic chair 10 via coupling gear 230. Similarly, seat depth can be adjusted via coupling gear 260 which connects to seat depth mechanism 250. Axial actuator 290 controls the travel of ball shifter 280 which in turn determines which of the coupling gears will be engaged. Additionally, in this implementation, ball shifter 285 can engage coupling gear 220 and coupling gear 240 simultaneously to adjust the seat height of programmable ergonomic chair 10.

FIG. 14 illustrates another perspective cross-sectional view of seat adjustment assembly 200 of programmable ergonomic chair 10, taken generally along line 14-14 in FIG. 12. This perspective shows the three-dimensional positioning of the various components.

FIGS. 15-19 illustrate cross-sectional views of an implementation of seat adjustment assembly 200 of a programmable ergonomic chair 10. In FIG. 15, ball shifter 280 is in a neutral position, that is, it is not engaging with any of the four ball couplers 210.

Figure 16:
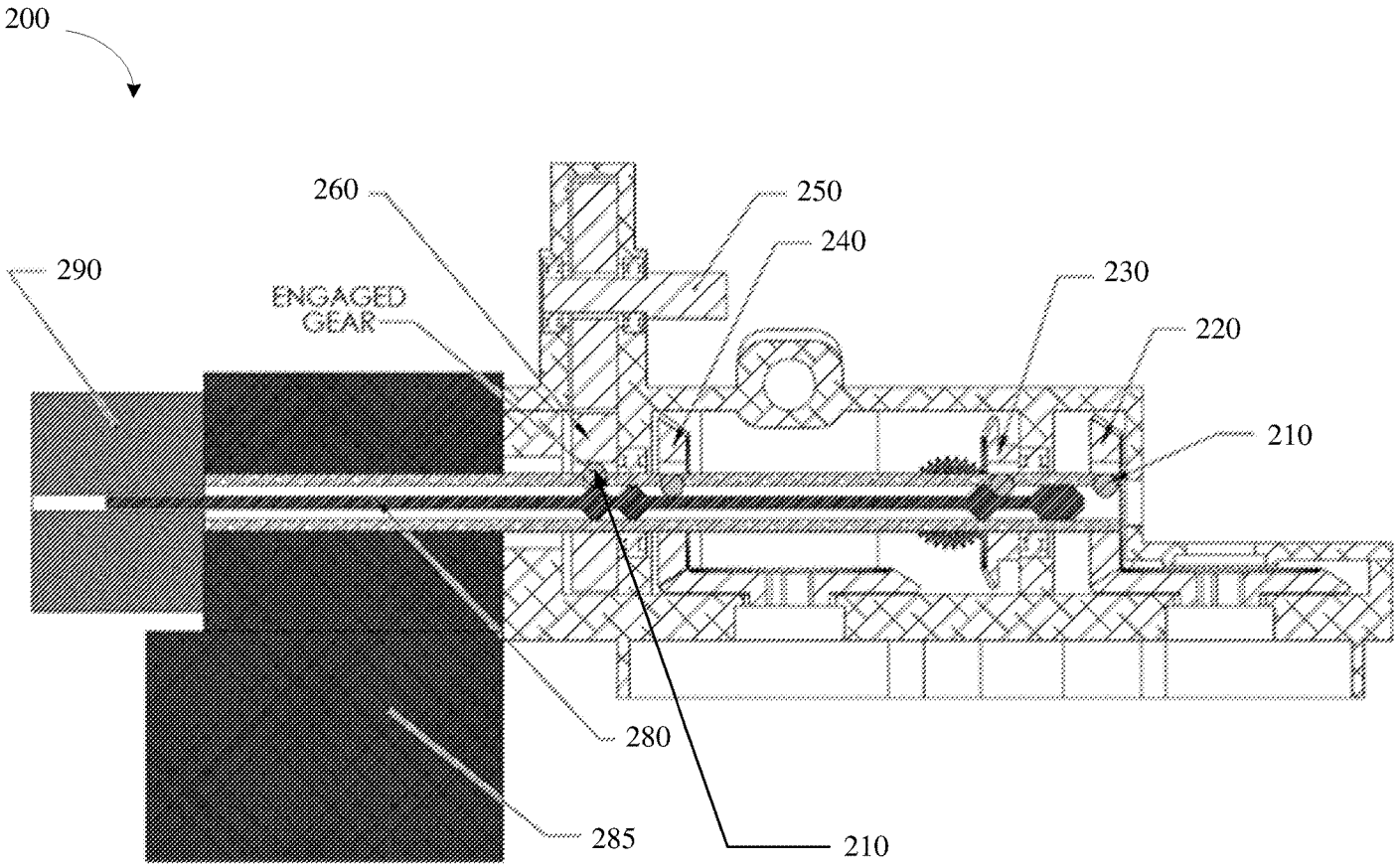
FIG. 16 illustrates a cross-sectional view of the ball-shift mechanism of a seat adjustment assembly of FIG. 15 in a seat depth adjustment position.

FIG. 16 illustrates the position of the ball shift mechanism of seat adjustment assembly 200 for adjusting seat depth. In this view, ball shifter 280 engages gear coupling 260 through ball coupler 210.

Figure 17:
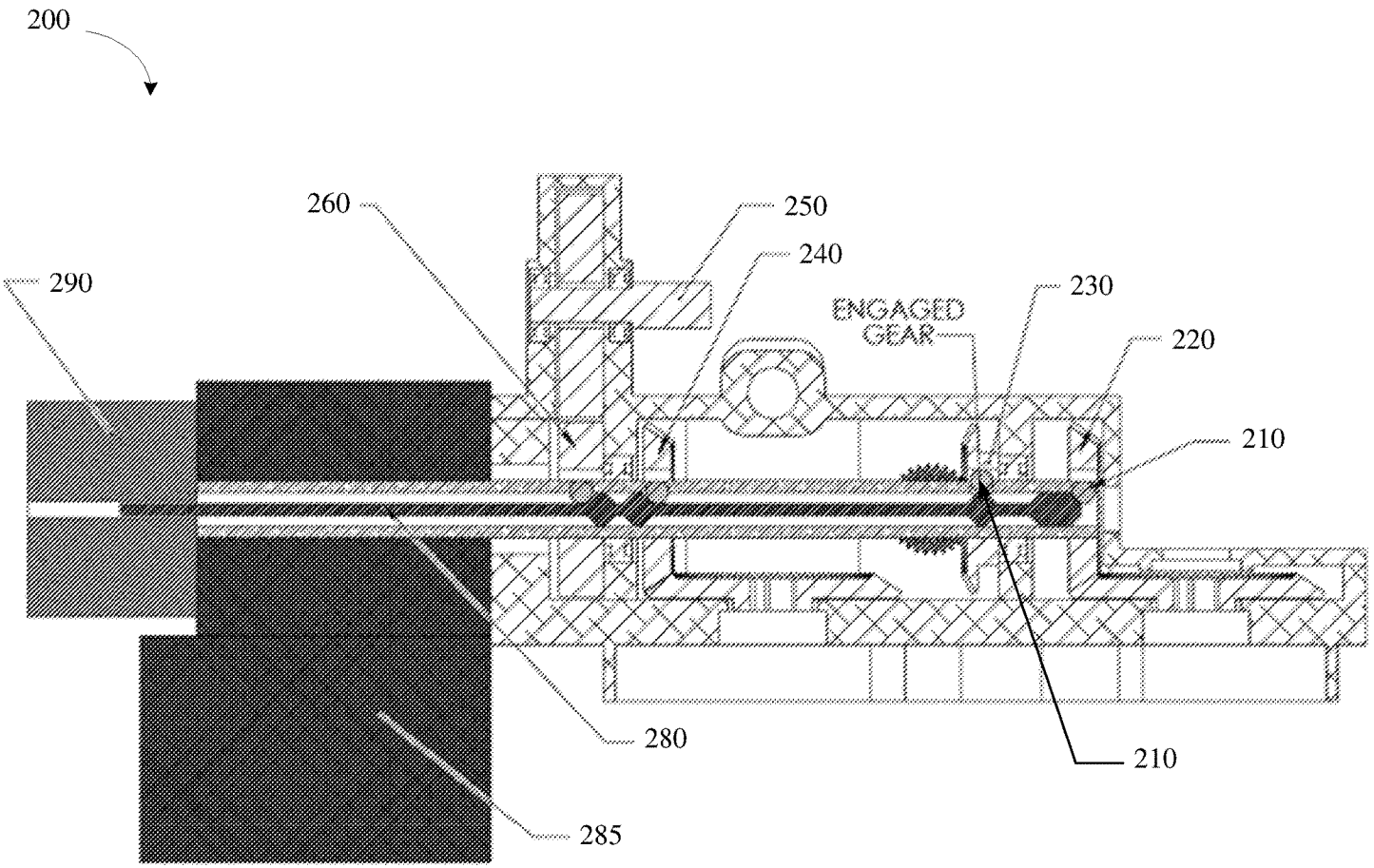
FIG. 17 illustrates a cross-sectional view of the ball-shift mechanism of the seat adjustment assembly of FIG. 15 in an armrest width adjustment position.

FIG. 17 illustrates the position of the ball shift mechanism of seat adjustment assembly 200 for adjusting armrest width. In this view, ball shifter 280 engages gear coupling 230 through ball coupler 210.

Figure 18:
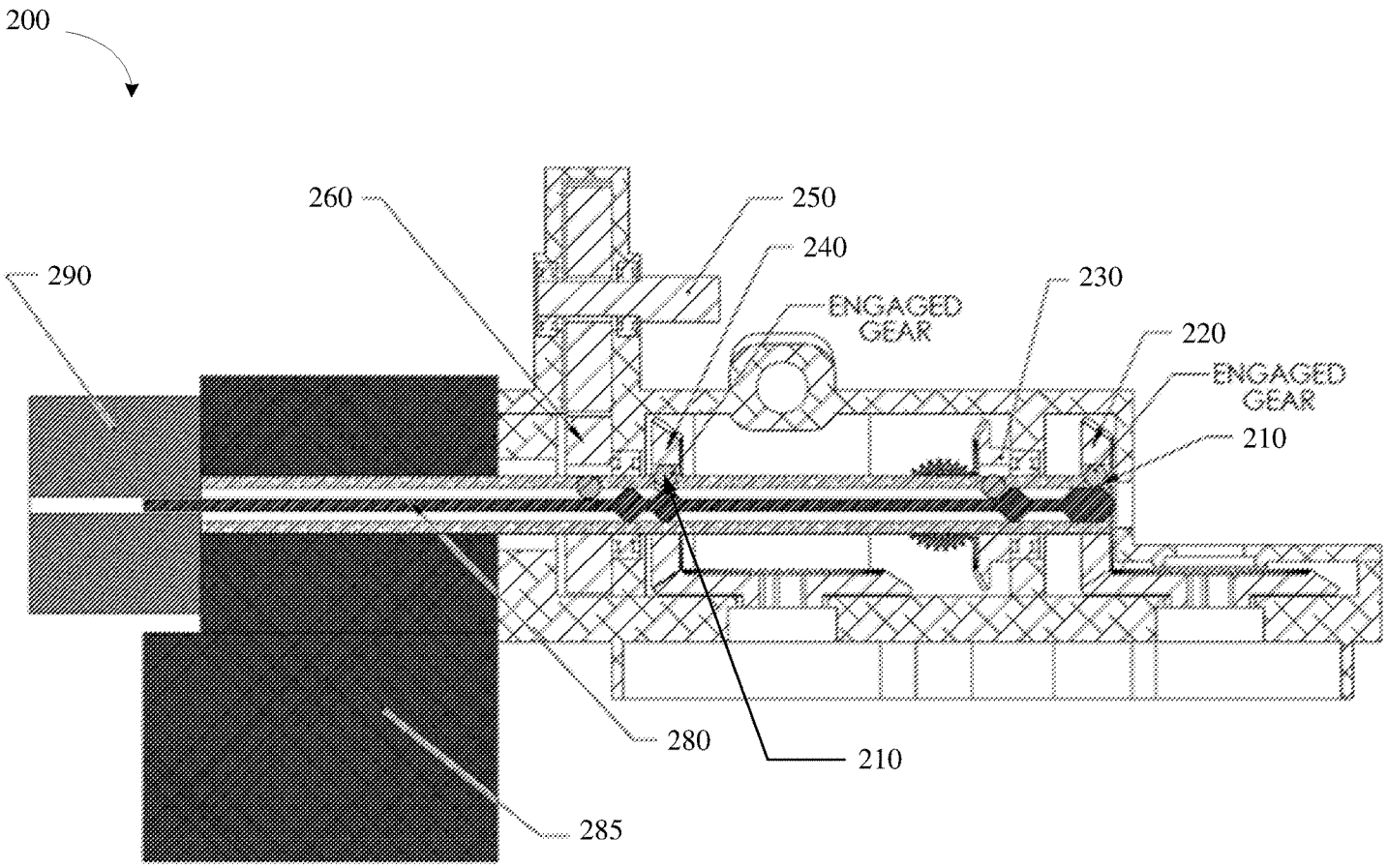
FIG. 18 illustrates a cross-sectional view of the ball-shift mechanism of the seat adjustment assembly of FIG. 15 in a seat height width adjustment position.

FIG. 18 illustrates the position of the ball shift mechanism of seat adjustment assembly 200 for adjusting seat height. In this view, ball shifter 280 engages gear coupling 220 and gear coupling 240 through ball couplers 210.

Figure 19:
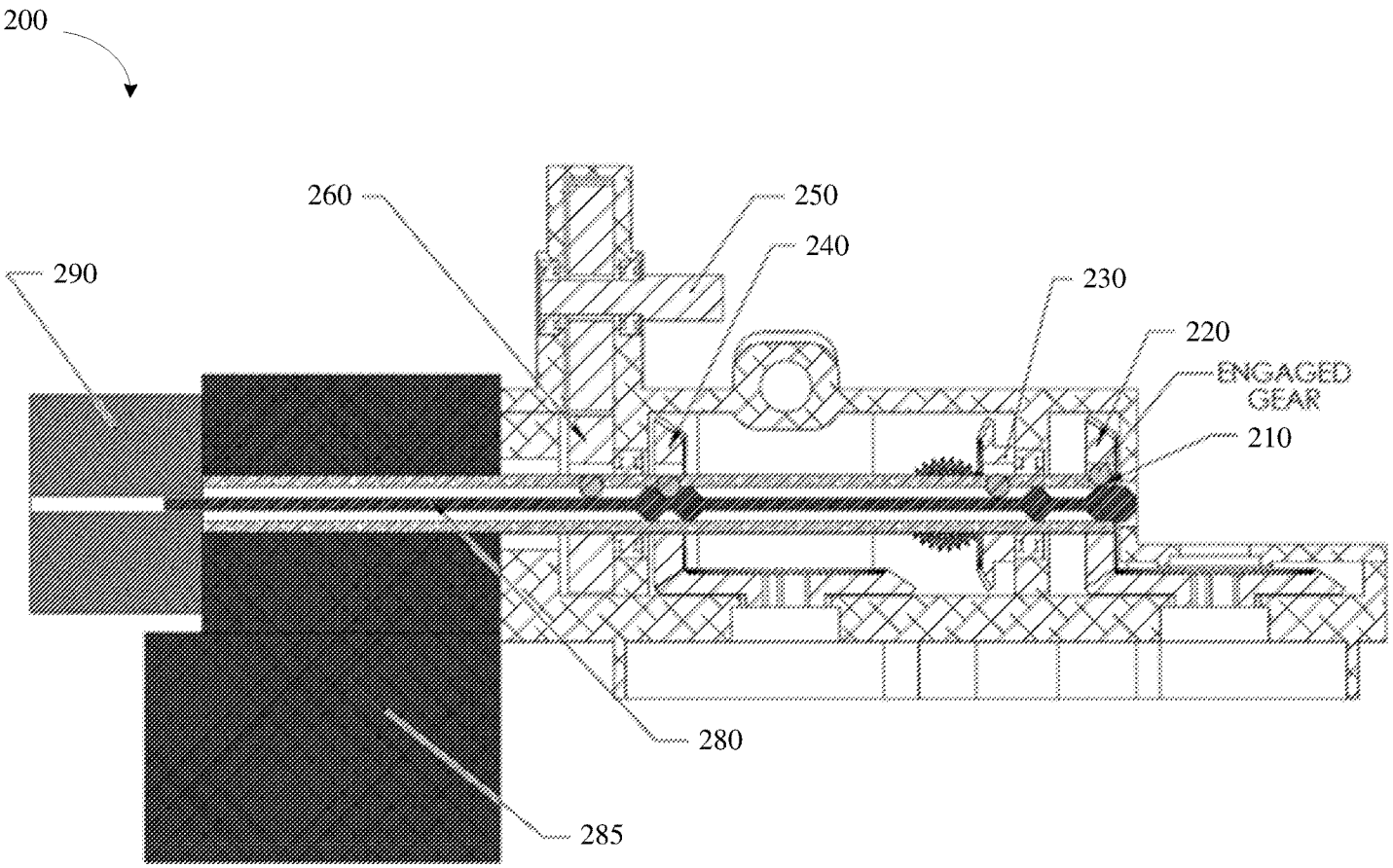
FIG. 19 illustrates a cross-sectional view of the ball-shift mechanism of the seat adjustment assembly of FIG. 15 in a seat tilt adjustment position.

FIG. 19 illustrates the position of the ball shift mechanism of seat adjustment assembly 200 for adjusting seat tilt. In this view, ball shifter 280 engages gear coupling 220 through ball coupler 210.

Figure 20:
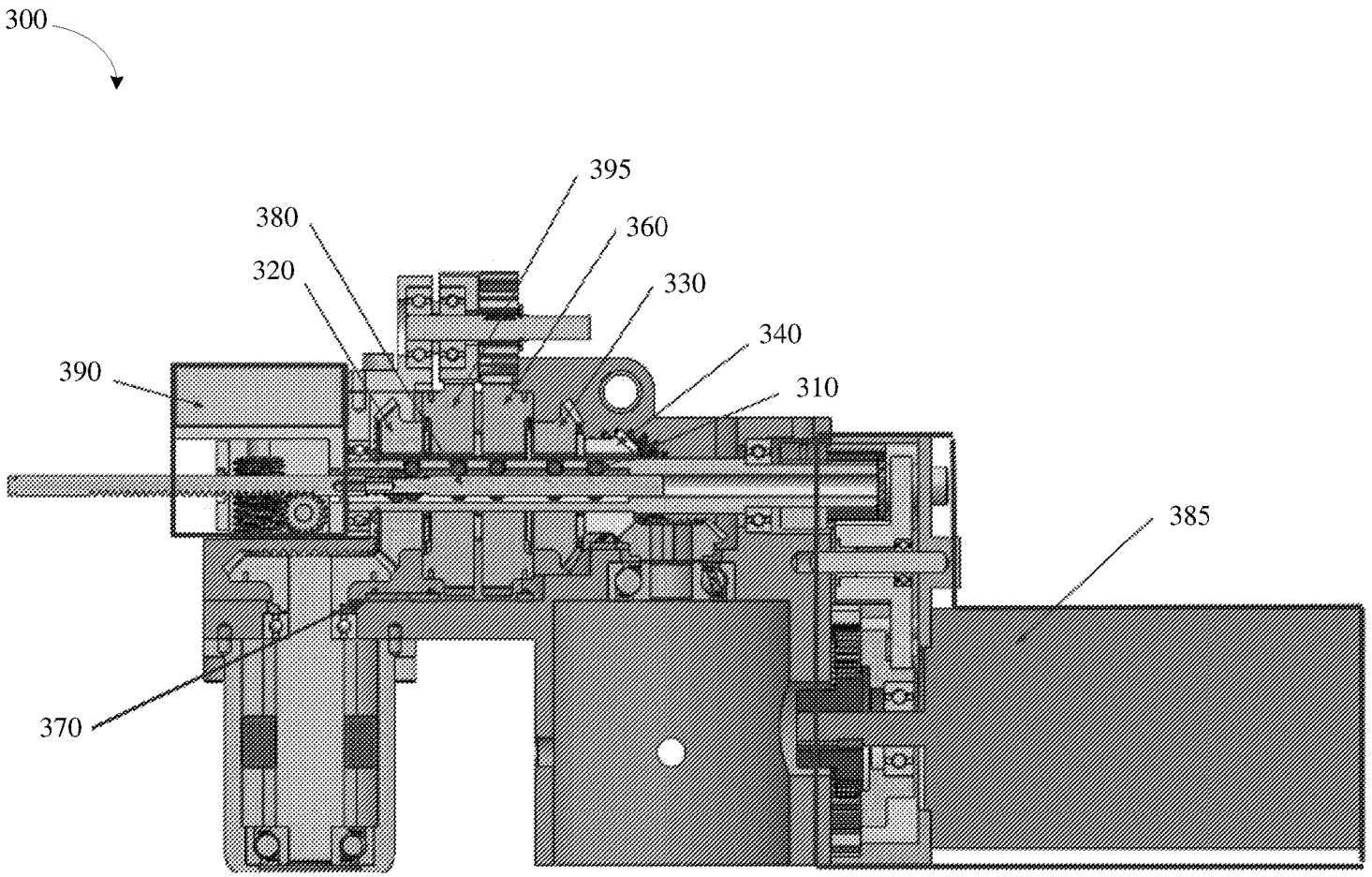
FIG. 20 illustrates a cross-sectional view of a ball-shift mechanism of the seat adjustment assembly in a neutral position in an implementation.

FIGS. 20-25 provide cross-sectional views another implementation of a programmable ergonomic chair which comprises seat adjustment assembly 300. In FIG. 20, the central actuation system controls five adjustments, including seat height, seat depth, seat tilt, armrest width, and backrest tilt. In this view, a sliding ball shifter 380 is in a neutral position, that is, it is not engaging any of the five ball couplers 310. In the process of actuating chair adjustments, axial actuator 390 controls the travel of ball shifter 380 which in turn determines which of the five coupling gears will be engaged. When a coupling gear is engaged, motor 385 drives the rotation of sliding ball shifter 380 which in turn drives the spur or bevel gears effecting the selected adjustment. In this implementation, motor 385 adjusts the width of the armrests via coupling gear 330. In a similar way, seat depth can be adjusted via coupling gear 360; backrest tilt is adjusted via coupling gear 395; seat tilt is adjusted via coupling gear 320; and seat height is adjusted via coupling gear 340.

Figure 21:
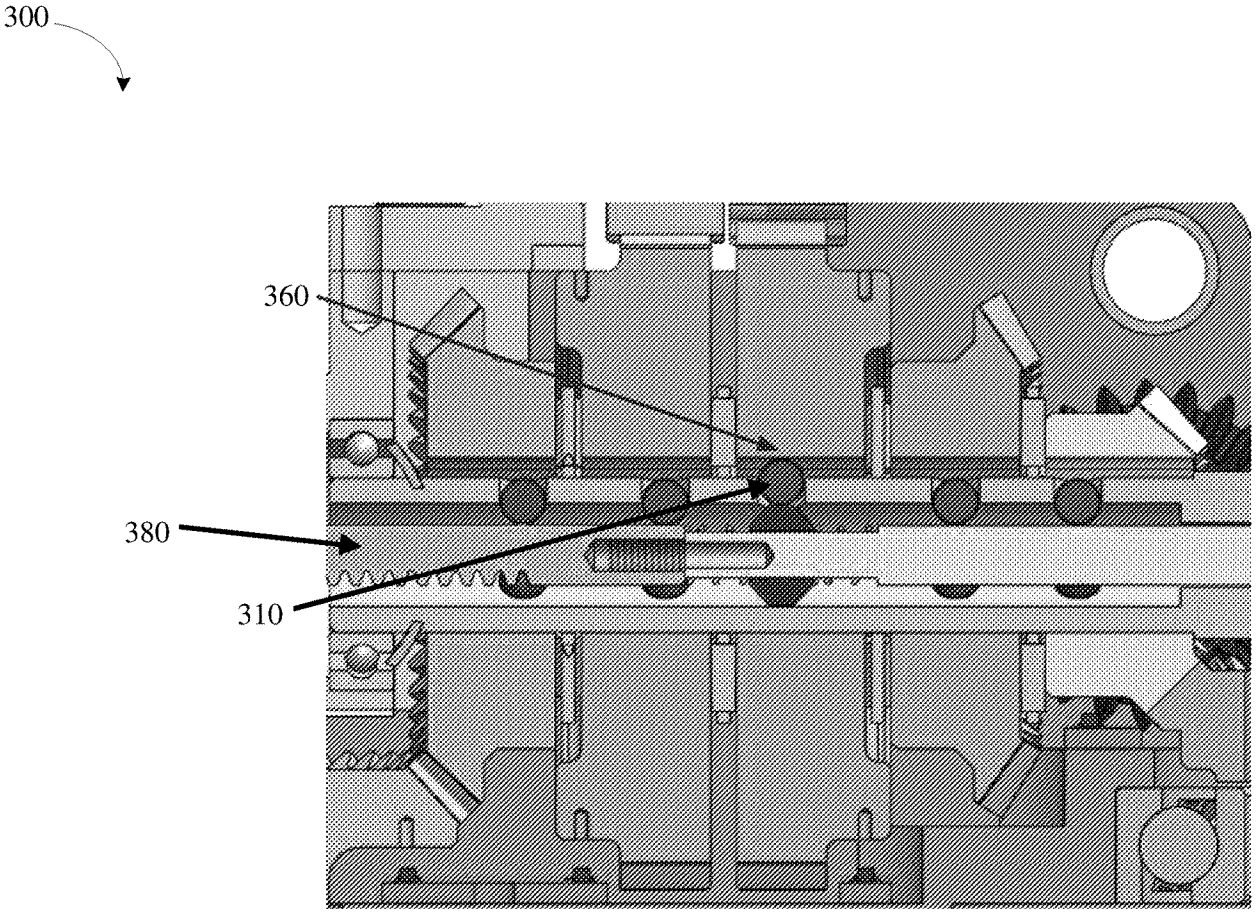
FIG. 21 illustrates a close-up cross-sectional view of the ball-shift mechanism of the seat adjustment assembly of FIG. 20 in a seat depth adjustment position.
Figure 22:
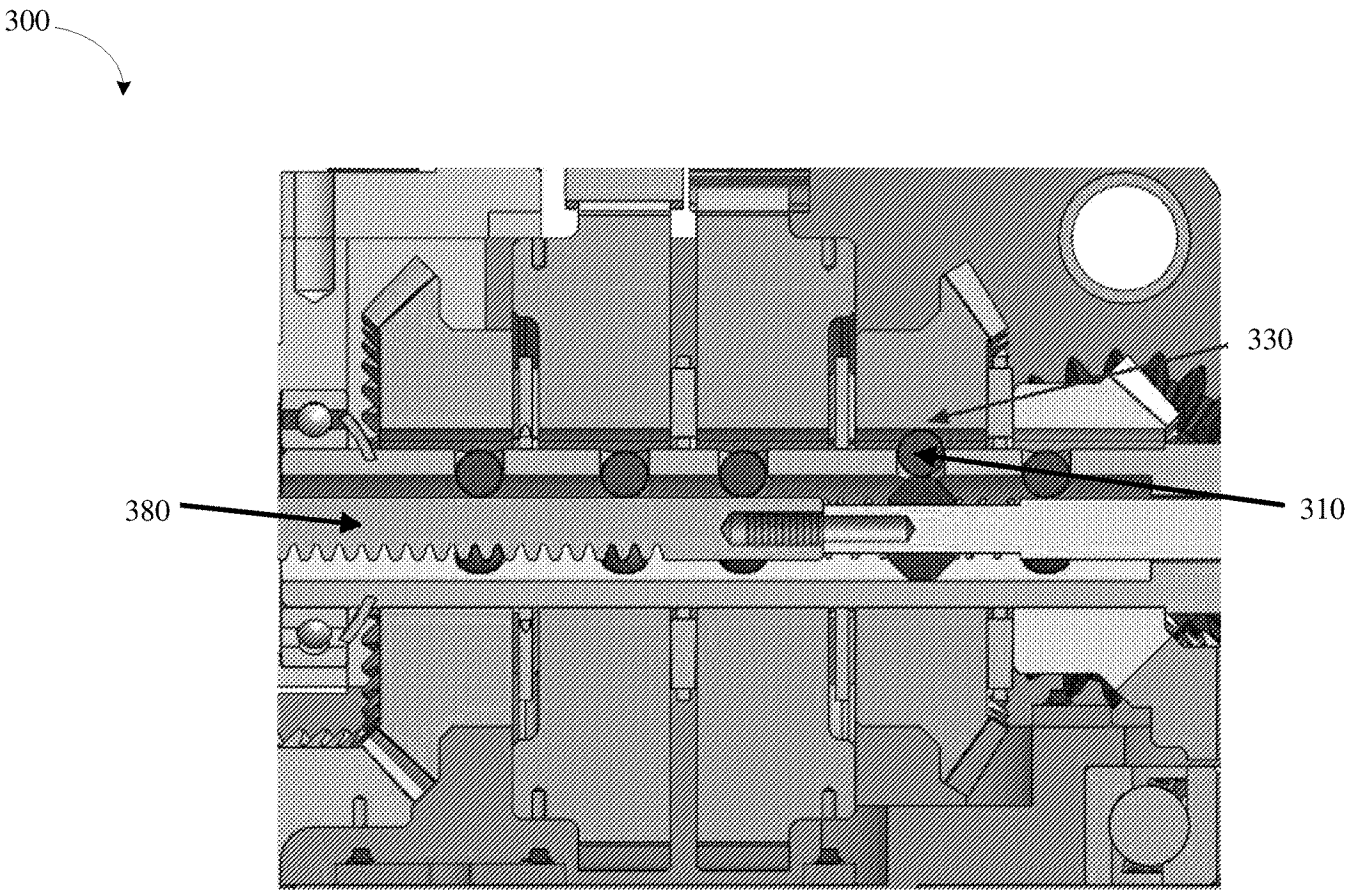
FIG. 22 illustrates a close-up cross-sectional view of the ball-shift mechanism of the seat adjustment assembly of FIG. 20 in an armrest width adjustment position.
Figure 23:
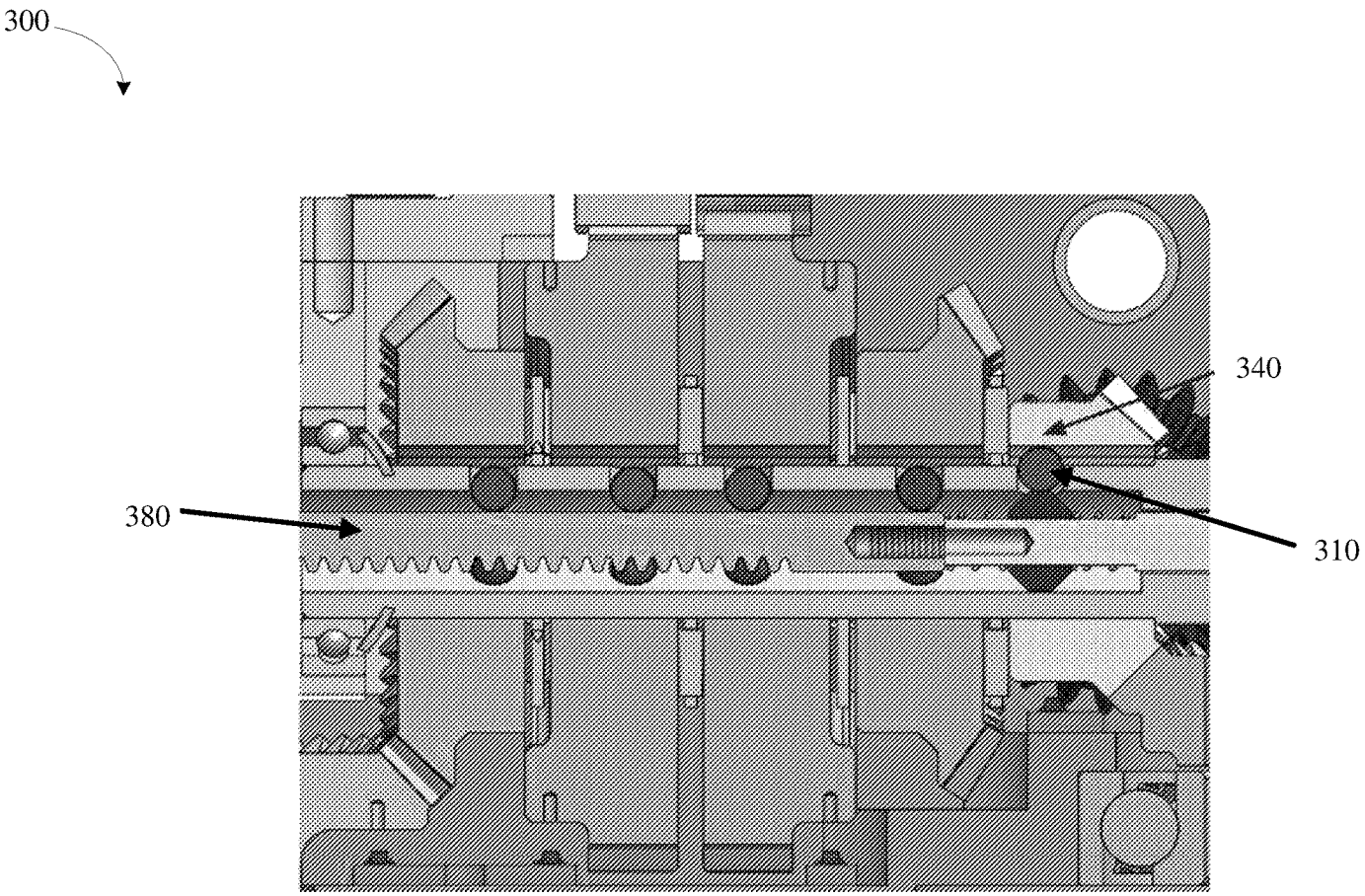
FIG. 23 illustrates a close-up cross-sectional view of the ball-shift mechanism of the seat adjustment assembly of FIG. 20 in a seat height adjustment position.
Figure 24:
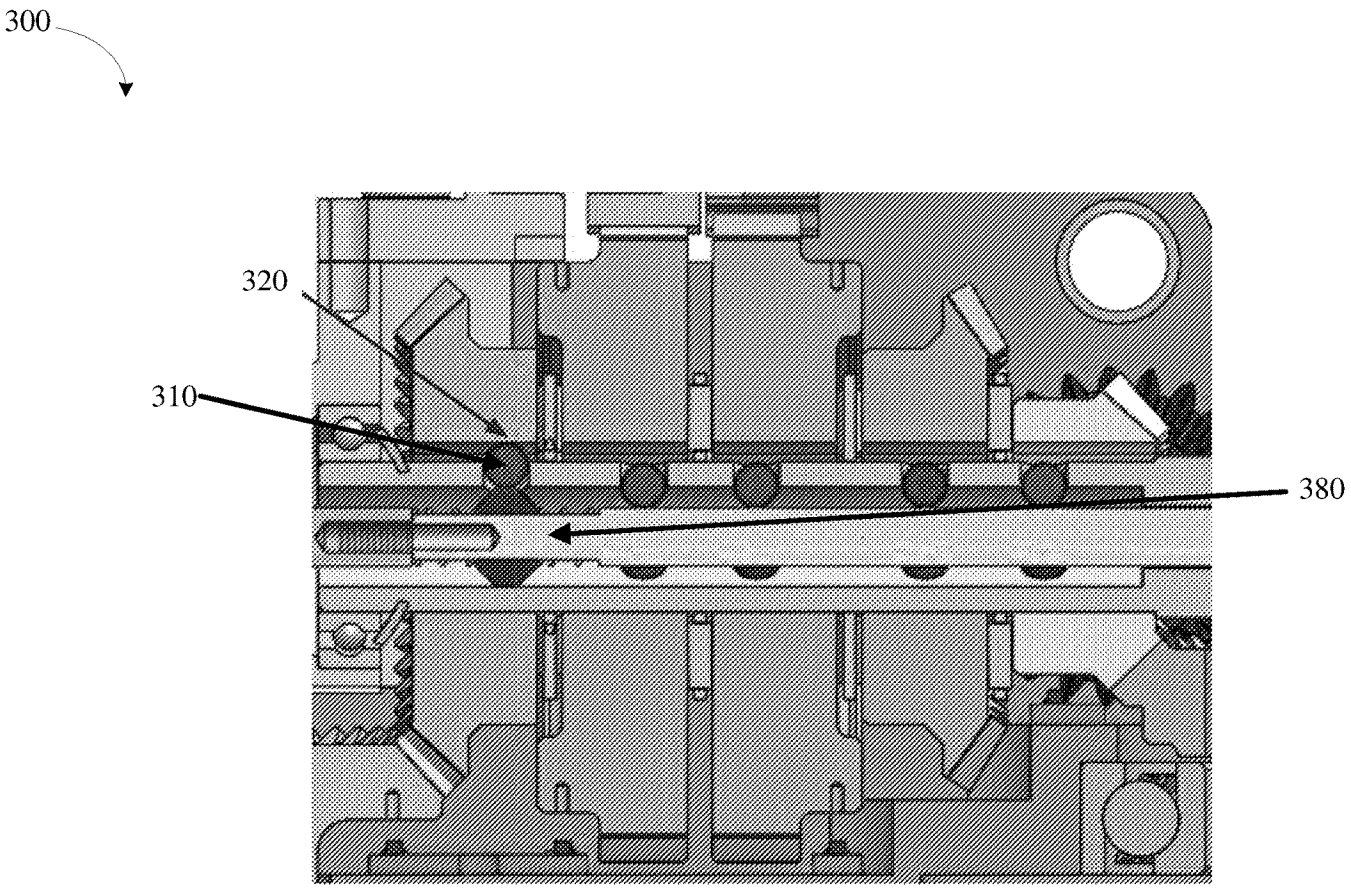
FIG. 24 illustrates a close-up cross-sectional view of the ball-shift mechanism of the seat adjustment assembly of FIG. 20 in a seat tilt adjustment position.
Figure 25:
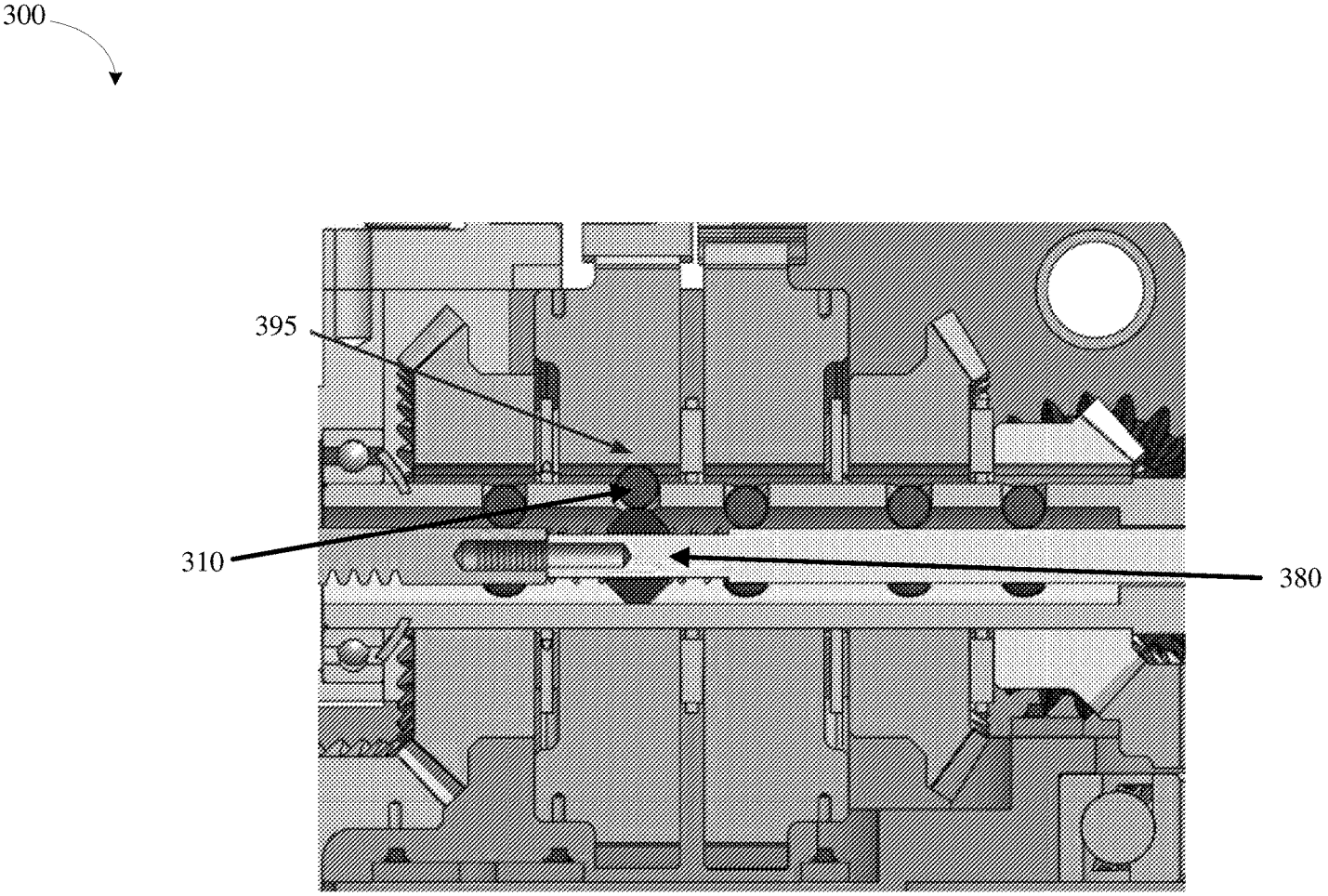
FIG. 25 illustrates a close-up cross-sectional view of the ball-shift mechanism of the seat adjustment assembly of FIG. 20 in a backrest tilt adjustment position.

FIGS. 21-25 illustrate close-up cross-sectional views of seat adjustment assembly 300 positioned for performing various adjustments. FIG. 21 illustrates ball shifter 380 causing ball coupler 310 to engage coupling gear 360 which adjusts seat depth. Similarly, FIG. 22 illustrates ball shifter 380 of seat adjustment assembly 300 causing ball coupler 310 to engage coupling gear 330 which adjusts armrest width. FIG. 23 illustrates ball shifter 380 of seat adjustment assembly 300 causing ball coupler 310 to engage coupling gear 340 which adjusts seat height. FIG. 24 illustrates ball shifter 380 of seat adjustment assembly 300 causing ball coupler 310 to engage coupling gear 320 which adjusts seat tilt. FIG. 25 illustrates ball shifter 380 of seat adjustment assembly 300 causing ball coupler 310 to engage coupling gear 395 which adjusts backrest tilt.

Figure 27:
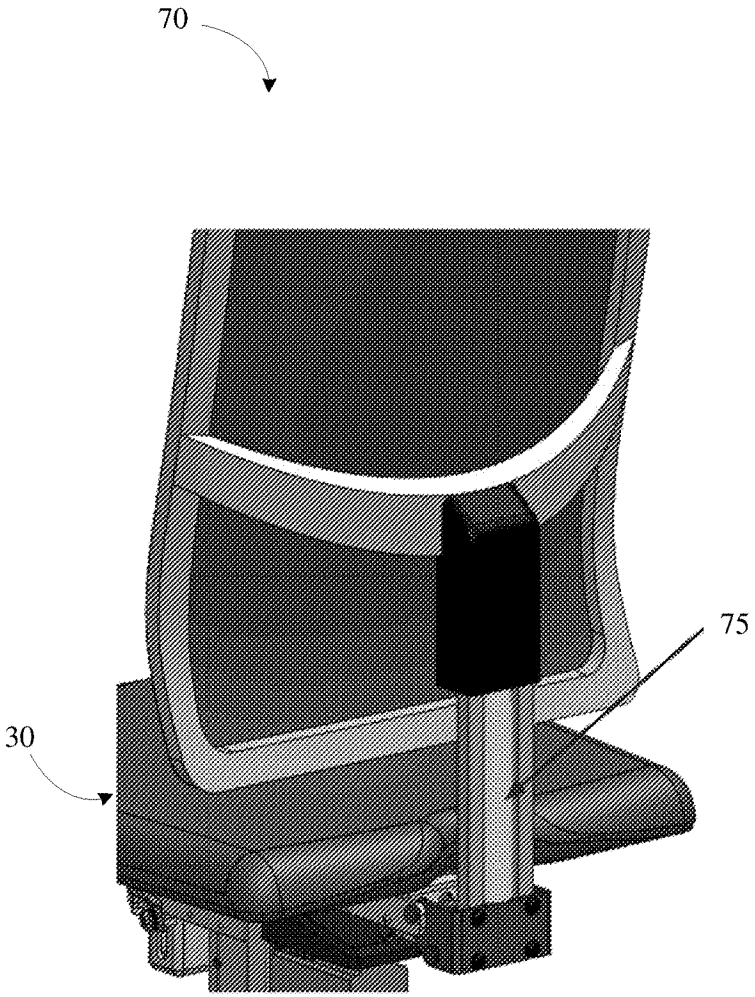
FIG. 27 illustrates a backrest assembly for adjusting backrest height in an implementation.
Figure 28:
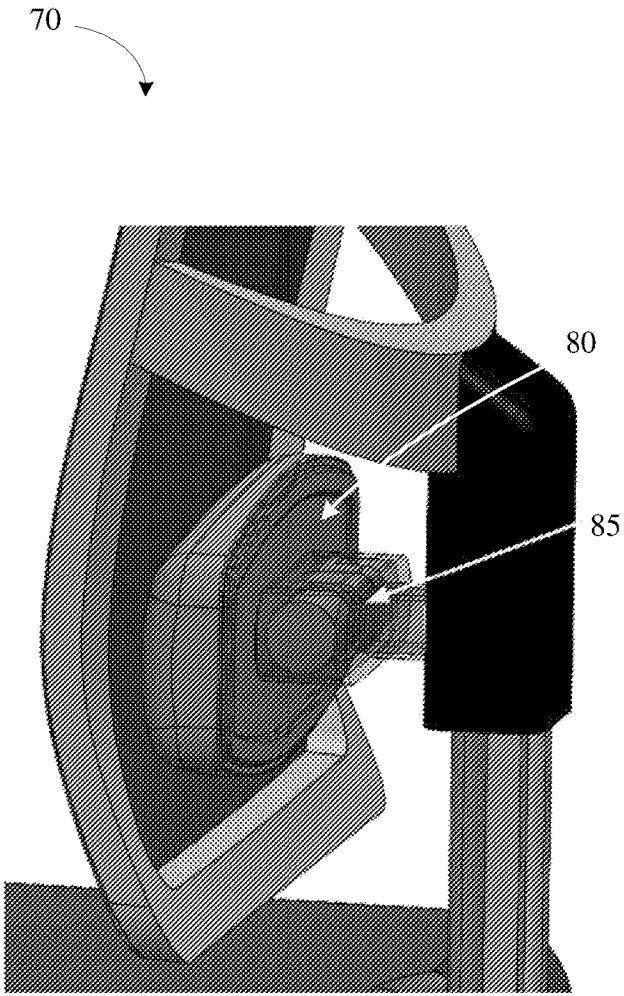
FIG. 28 illustrates a backrest assembly for adjusting lumbar support density in an implementation.

FIGS. 26-28 illustrate secondary actuations of a programmable ergonomic chair. FIG. 26 illustrates an implementation of an armrest height adjustment effected by a motor 45 which is controlled by a microprocessor onboard the chair. In an implementation, the microprocessor receives an adjustment setting from a software application running on a mobile device, implementations of which are illustrated in FIGS. 32-40 and 42-46. The software application has calculated an ergonomically optimal armrest height setting based on a user's body measurements and other relevant personal data and has transmitted this information via a wireless communication protocol such as Bluetooth® to the user's programmable ergonomic chair. A central processor onboard the chair receives the setting and activates motor 45 to adjust the armrest height according to the ergonomically optimal armrest height determined by the software application.

Similarly, FIG. 27 illustrates backrest height adjustment operated by a secondary linear actuator 75 which includes a motor to adjust the height of backrest 70 relative to seat 30. In an implementation, the software application running on a user's mobile device has calculated an ergonomically optimal backrest height setting and has transmitted this information via a wireless communication protocol to the user's programmable chair. A central processor onboard the chair receives the setting and activates linear actuator 75 to raise or lower backrest 70 according to an ergonomically optimal lumbar support height determined by the software application.

FIG. 28 illustrates a lumbar depth or firmness adjustment operated by a secondary actuation the form of air pump 85 which inflates or deflates lumbar support 80. In an implementation, the software application running a user's mobile device has calculated an ergonomically optimal lumbar support density or firmness setting and has transmitted this information via a wireless communication protocol to the user's programmable chair. A central processor onboard the chair receives the setting and activates air pump 85 to inflate or deflate lumbar support 80 according to an ergonomically optimal lumbar support density or firmness determined by the software application.

Figure 29:
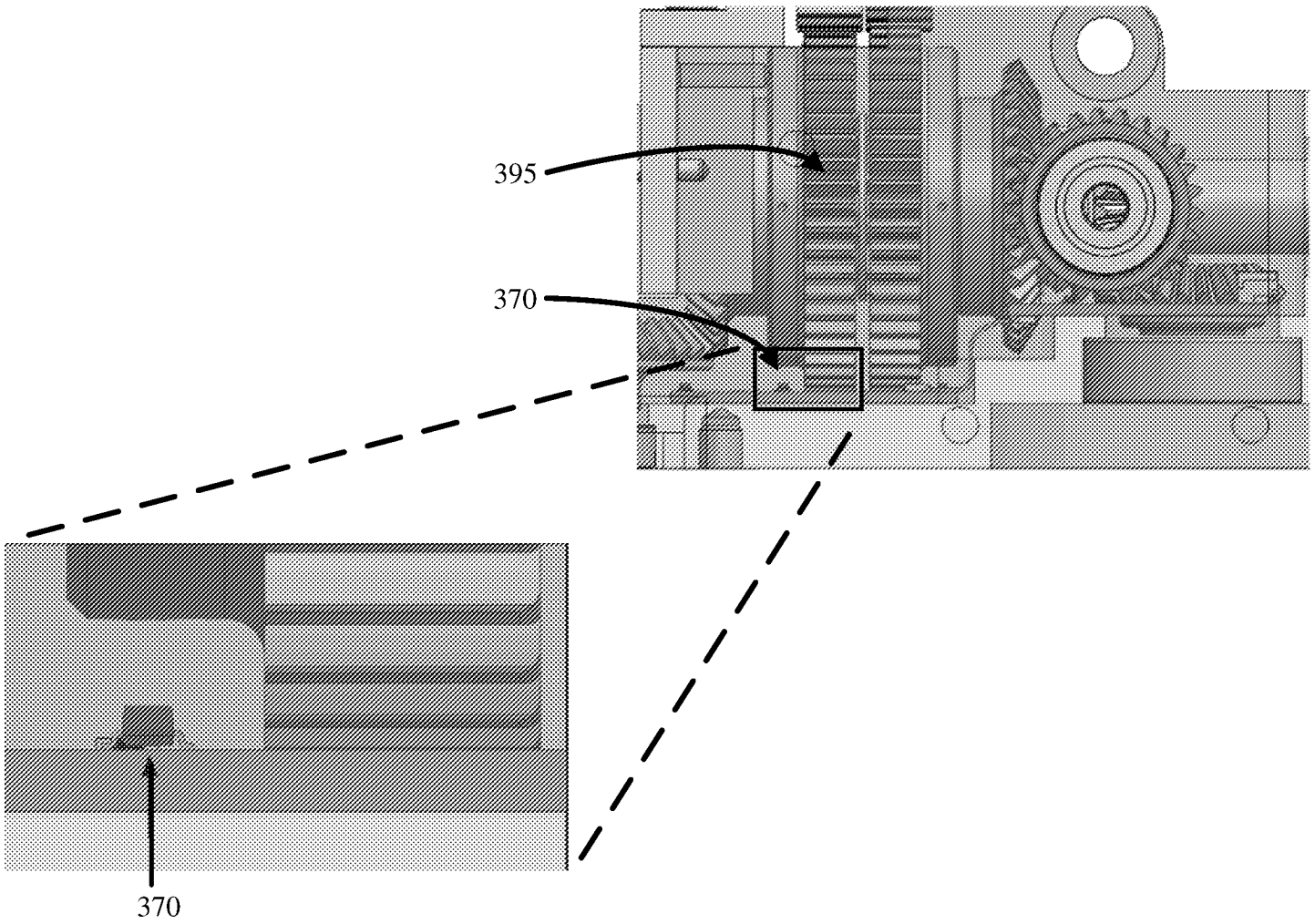
FIG. 29 illustrates an encoder system for tracking the count and direction of rotation of a coupling gear in an implementation.

FIG. 29 illustrates an implementation of a closed-loop encoder feedback system on a programmable ergonomic chair. In an implementation, encoder 370 comprises a magnetic switch which transmits a signal as a magnet (not shown) affixed to gear coupling 395 (controlling backrest tilt) passes the switch as gear coupling 395 rotates. Thus, encoder 370 enables the central processor to keep track of the direction and number of rotations of gear coupling 395 in the process of adjusting the backrest tilt. Other gear couplings are similarly tracked by encoders, including an attached magnet and a corresponding magnetic switch. The encoders allow the central processor to control the central and secondary actuation motors to perform the adjustments corresponding to the user's ergonomically optimal chair positions.

Figure 30:
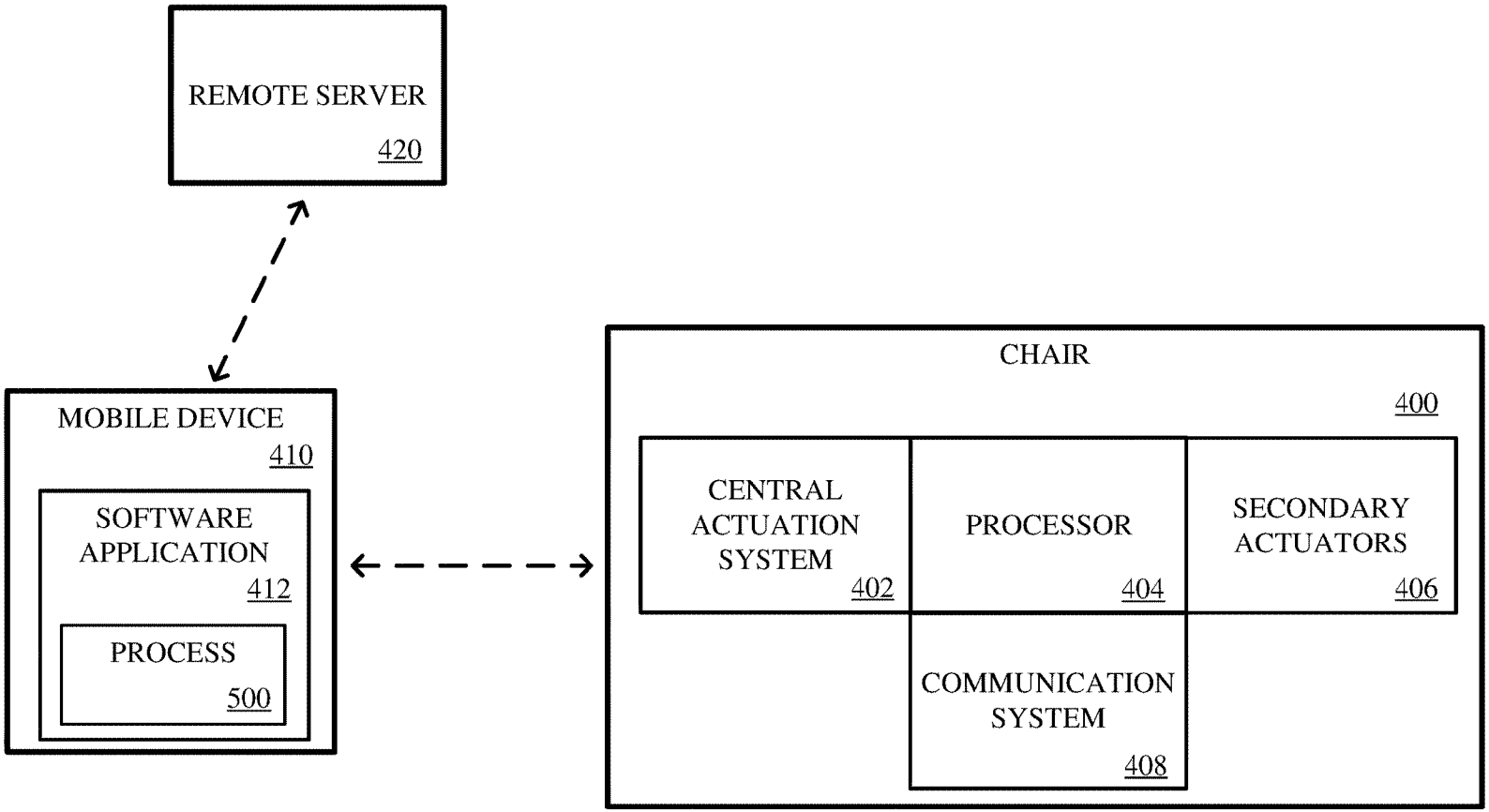
FIG. 30 illustrates functional relationships between a programmable ergonomic chair, a mobile device, and a central server in an implementation.

FIG. 30 is a functional block diagram illustrating interaction between a chair 400 which is an implementation of a programmable ergonomic chair, a mobile device 410, and a central server 420. Chair 400 has processor 404 which performs several functions including: accepting and interpreting direct and indirect inputs from software application 412 operating on mobile device 410; recalling and/or updating the position of each of the actuations of chair 400; commanding motor drivers which set the speed, direction, and duration of the each motor's actuation according to ergonomic parameters determined by software application 412 running on mobile device 410; and obtaining sensory feedback of the actuations, which may also include global attitude or orientation information about chair 400 such as absolute angle or tilt data, acceleration data, rotation data, and the like. Processor 404 may also interface with an onboard wireless communication system 408 for communication with mobile device 410. Optionally, chair 400 also comprises a rechargeable battery power system.

Chair 400 further comprises a central actuation system 402 and one or more secondary actuators 406. Central actuation system 402 include a DC motor coupled with a bespoke parallel output shaft gearbox. Secondary actuators 406 include individual actuations operated by dedicated motors which can be turned on or off independently. In an implementation of programmable chair 400, central actuation system 402 can control adjustments of seat depth, armrest width, seat height, and seat tilt, while secondary actuators 406 control adjustments of armrest height, backrest height, backrest tilt, and lumbar support density.

In alternative implementation of chair 400, central actuation system 402 controls adjustments of seat depth, armrest width, seat height, seat center tilt, and backrest tilt, while secondary actuators 406 control adjustments of armrest height, backrest height, and lumbar support density.

Implementations of mobile device 410 of FIG. 30 can include a smartphone, tablet computer, laptop computer, wearable computing device, or the like. Software application 412 executes process 500 (illustrated in FIG. 31 below) which performs several functions including: measuring critical physiological landmarks of a user's body; collecting and processing critical measurements to calculate optimum ergonomic positions to fit the user's body; creating and sending a code to chair 400 to be processed by processor 404; and sending data to remote server 420 for storage and future analysis. The optimum ergonomic positions calculated by software application 412 include seat height, seat center tilt, seat depth, armrest height, armrest width, backrest height, backrest tilt, and lumbar support density or firmness. Additional functions of software application 412 may include storing the user's settings; enabling manual override by the user of the calculated ergonomic positions; sending and storing the user's override settings to remote storage 420; and enabling scheduled automatic chair adjustments which provides for different ergonomic position settings according to the time of day, for example.

In an implementation, mobile device 410 communicates with chair 400 via Bluetooth®, although communication via near-field communication (NFC), wireless communication or even wired communication is contemplated and considered to be within the scope of the claims.

Remote server 420 is representative of a remote or cloud data storage system. Remote server 420 collects and stores data received from one or more mobile devices 410 running software application 412. Remote server 420 performs several functions, including: collecting and storing the IP address and geographic location of mobile device 410, the date and time that the user's measurements were made; the user's height, sex, body, and chair measurements and settings; the code created by software application 412 that is transmitted to chair 400; and any manual overrides by the user. Remote server 420 may also include the ability to update software application 412.

Implementations of remote server 420 may also include one or more server computers co-located or distributed across one or more data centers to which mobile device 410 connects. Examples of such servers include web servers, application servers, virtual or physical servers, or any combination or variation thereof, of which remote server 420 is broadly representative.

Wireless communication between mobile device 410 and remote server 420 may conducted over a communication network such as an internet or intranet, the Internet, wired and wireless networks, local area networks, wide area networks, or any other type of network or combination thereof.

Figure 31:
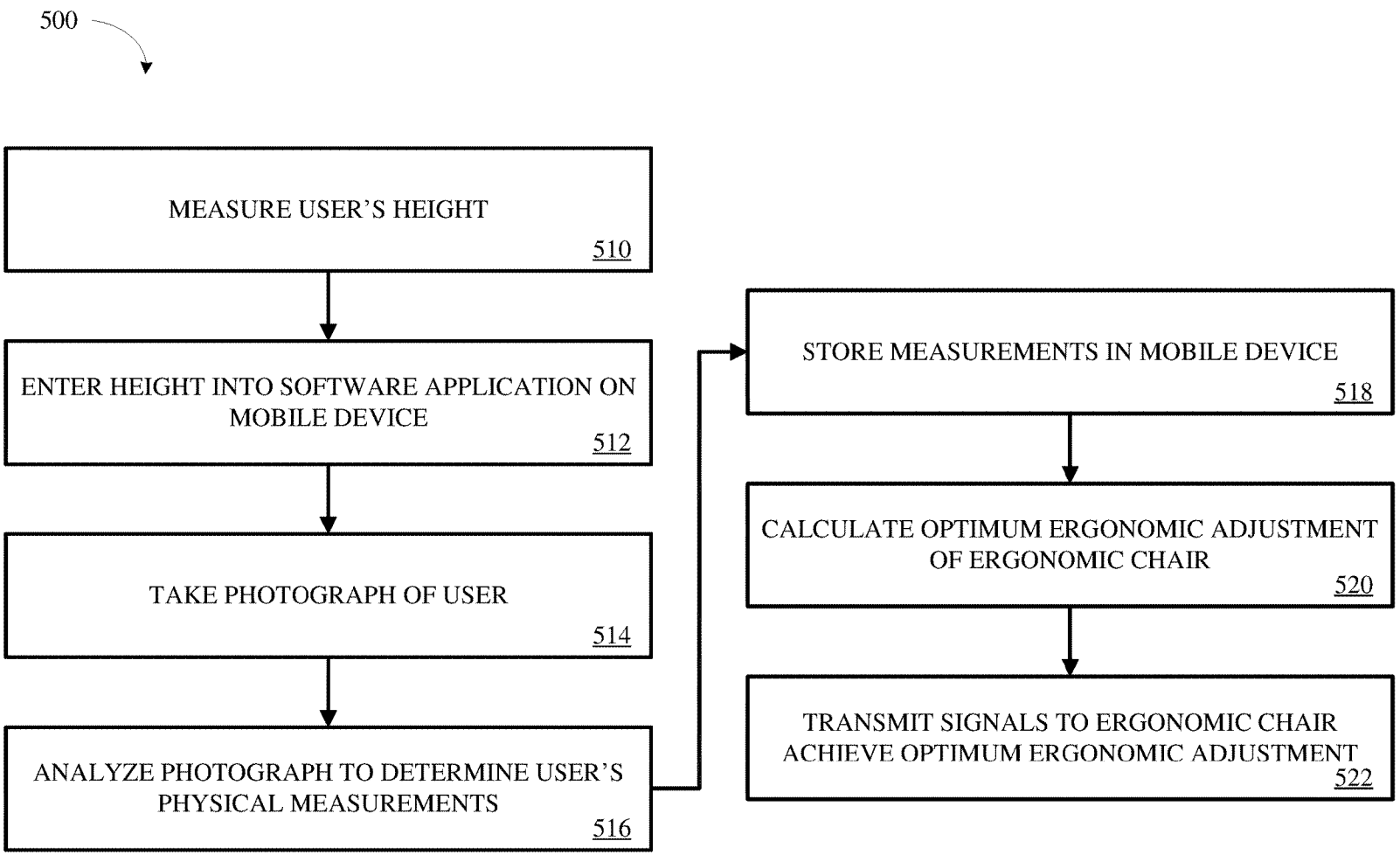
FIG. 31 illustrates a workflow for adjusting a programmable ergonomic chair in an implementation.

FIG. 31 illustrates process 500 of adjusting an ergonomic chair. Process 500 may be implemented in program instructions executed by one or more processors on a suitable computing device of which computing device 602 of FIG. 47 (described below) is representative. In an implementation, a user begins by measuring the user's height (step 510). The user launches a software application operating on the user's mobile device, which prompts the user to enter his or her height (step 512). This step can be implemented in the form of a textbox displayed in the user interface where the user can key in his or her height. The application prompts the user to take one or more full-body photographs of the user from various perspectives, such as an anterior or posterior view and a lateral view from the user's left or right side (step 514). Using the photographs, the application analyzes the photographs to determine the user's physical measurements (step 516). These measurements are distances between various body landmarks which include the top of the user's head, the point where the user's heel meets the floor, the middle of the user's elbow, the middle of the user's lumbar curve, the most protruding part of the user's buttocks, and the base of the user's knee. Other distances determined from the photographs include the widest distance between the user's deltoid muscles and the widest distance between the user's hips. The software application determines distances on the photographs by scaling the photographs according to the user's height, and then calculating the distances from points indicated by the user on the photographs that mark the various landmarks. The application then stores these measurements on the mobile device (step 518). The application may also store these measurements in remote data storage to which the mobile device is in wireless communication where the can be retrieved for later use or analysis. Next, the application calculates the optimum ergonomic adjustments of the user's ergonomic task or office chair according to the user's physical characteristics (step 520). These adjustments are computed based on factors selected from the group consisting of ergonomics, human factors, physiology, anatomy, biomechanics, anthropometry, and kinesiology. Finally, the application transmits information to the chair comprising the ergonomic adjustments determined based upon the user's physical characteristics (step 522). A central processor onboard the chair receives this information via a wireless communication system such as Bluetooth® and controls the various motors to implement the adjustments necessary to achieve the optimum ergonomic adjustments of the chair for the user.

FIGS. 32-39 illustrates implementations of workflows and processes of a software application such as software application 412 of FIG. 30 operating on a mobile device such as mobile device 410. In this illustration, a user is using his or her smartphone to control a programmable ergonomic chair such as chair 400 of FIG. 30.

Figure 32:
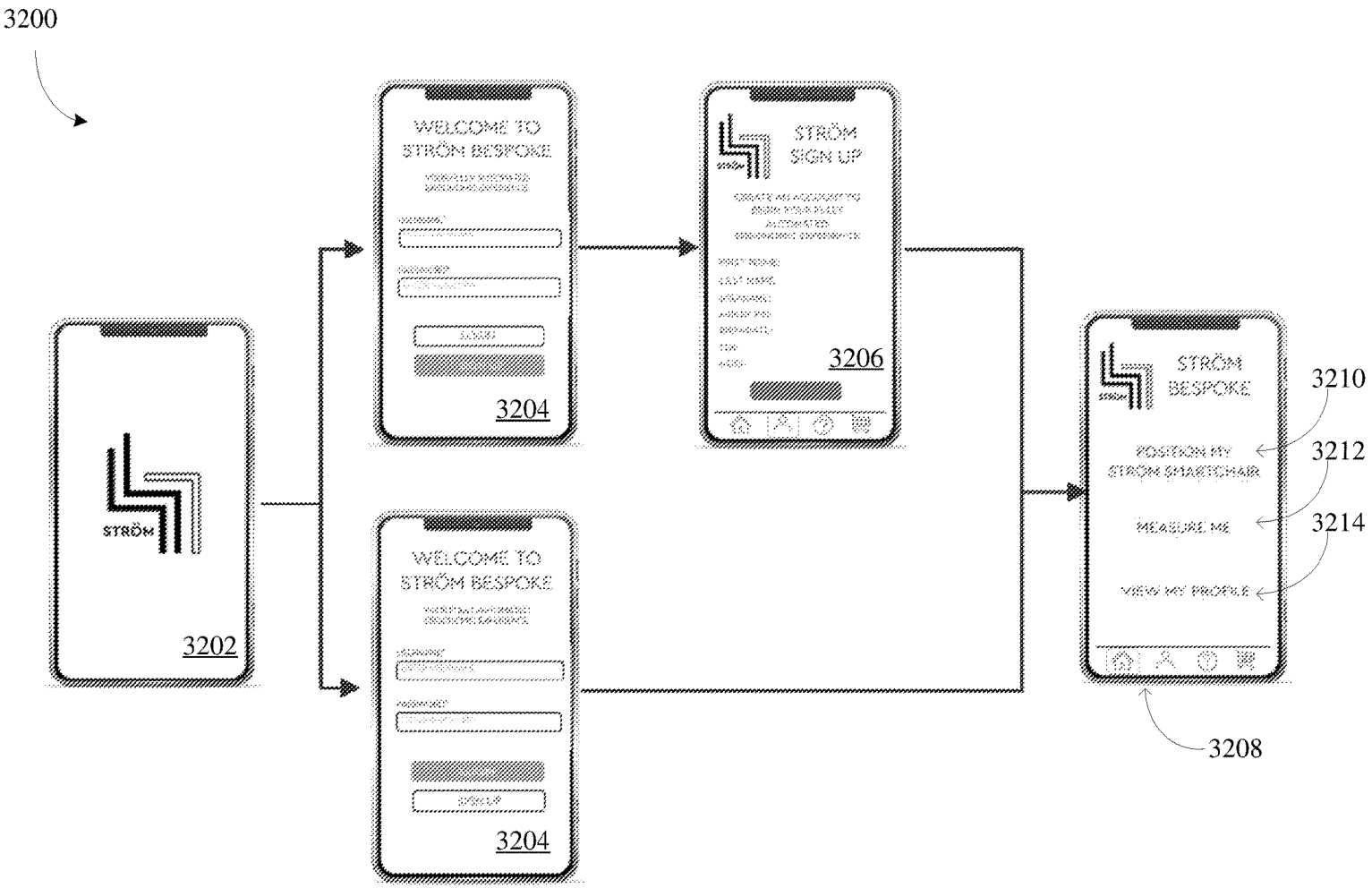
FIGS. 32-39 illustrate screenshots of various functions a software application in an implementation.

Workflow 3200 of FIG. 32 illustrates a start-up screen 3202 and login screen 3204 displayed on the user's smartphone. At login screen 3204, the user is prompted to login to a previously created account or to create a new account. If the user chooses to create a new account, the software application displays an account creation screen 3206 where the user enters a personal data for his or her account, such as first and last name, an account username, a security PIN, the user's birthdate, the user's sex, and the user's height. After entering this information, the software application displays home screen 3208 with a menu of choices for the user to select from, including the options to position a programmable ergonomic chair (virtual button 3210), to measure the user's body (virtual button 3212), or to view the user's account profile information (virtual button 3214).

Figure 33:
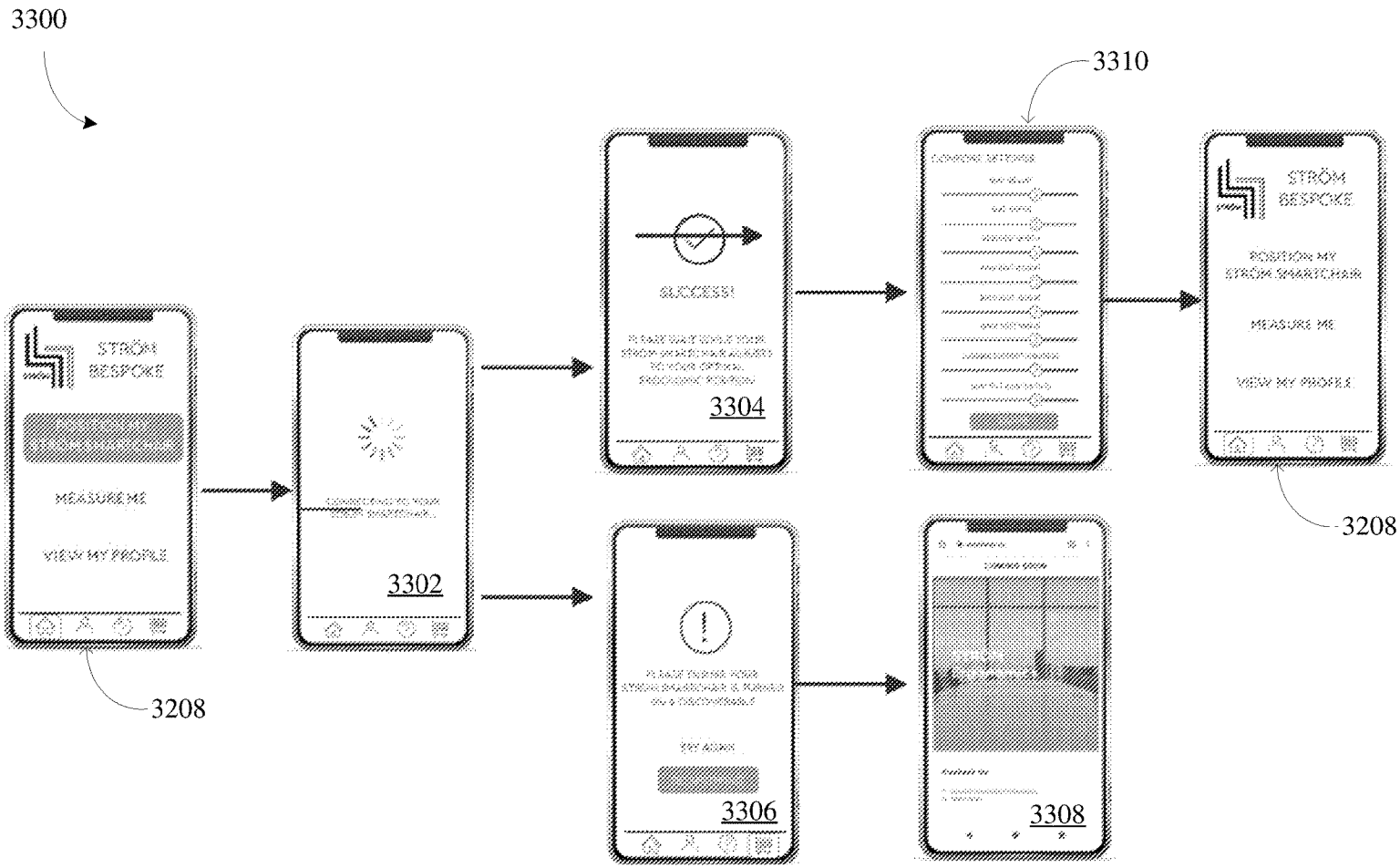

Workflow 3300 of FIG. 33 illustrates the software application process which occurs when the user chooses to position a programmable ergonomic chair at home screen 3208. The mobile device displays a pause screen 3302 as it attempts to connect to the discoverable programmable ergonomic chair. In an implementation, the smartphone connects via Bluetooth® to the chair, upon which it displays a success screen 3304; alternatively, if the smartphone fails to connect to a programmable ergonomic chair, it displays a failure screen 3306 and then a manufacturer website information screen 3308 for the user to seek assistance. If the smartphone is able to connect to the chair, the application displays a settings screen 3310 showing the adjustments that are applicable to the chair. At settings screen 3310, the user can view and/or modify the adjustments which have been previously determined for that user. In an implementation, each adjustment is displayed as a slider. When the user has completed viewing and/or modifying the adjustments, the application returns to home screen 3208.

Figure 34:
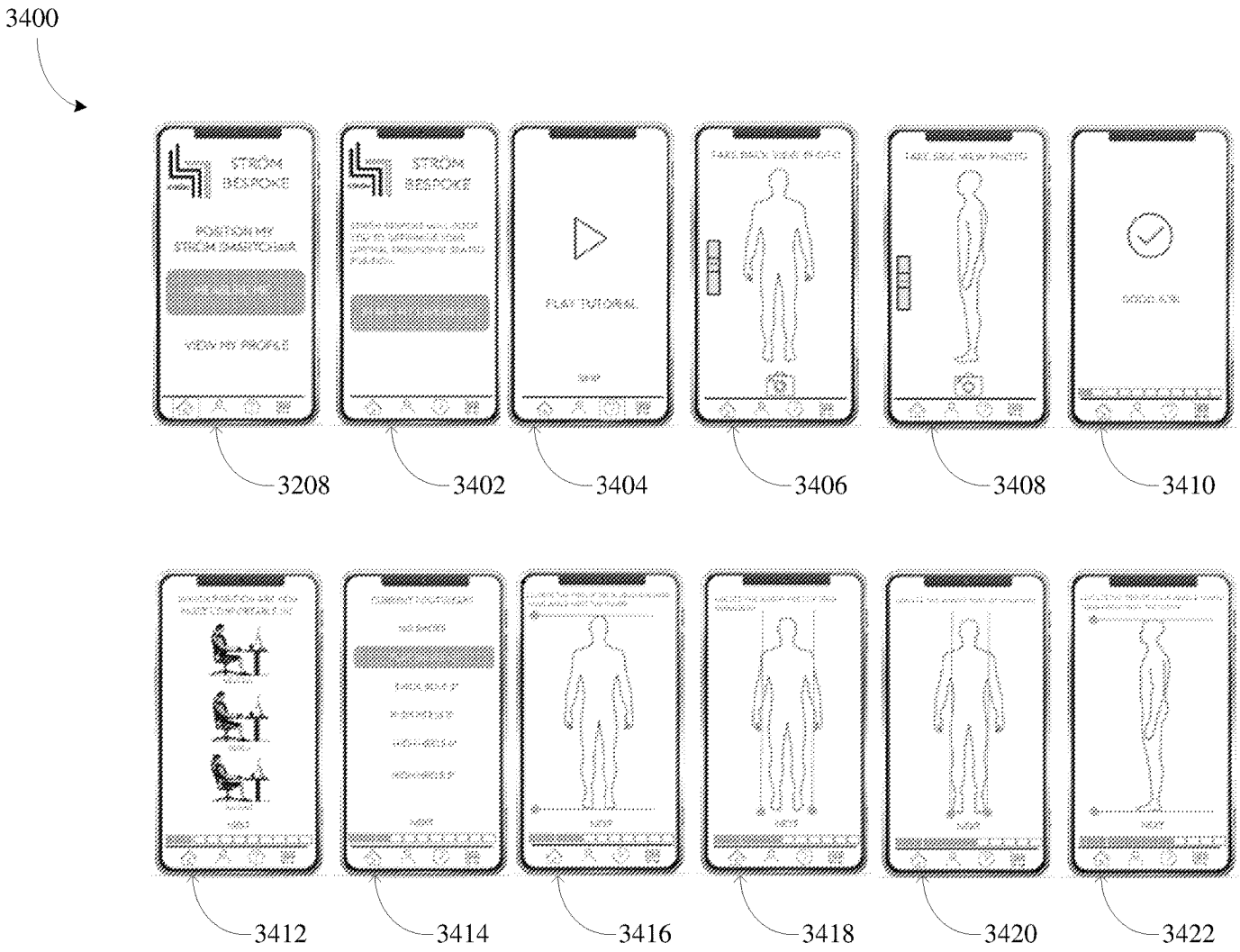
Figure 35:
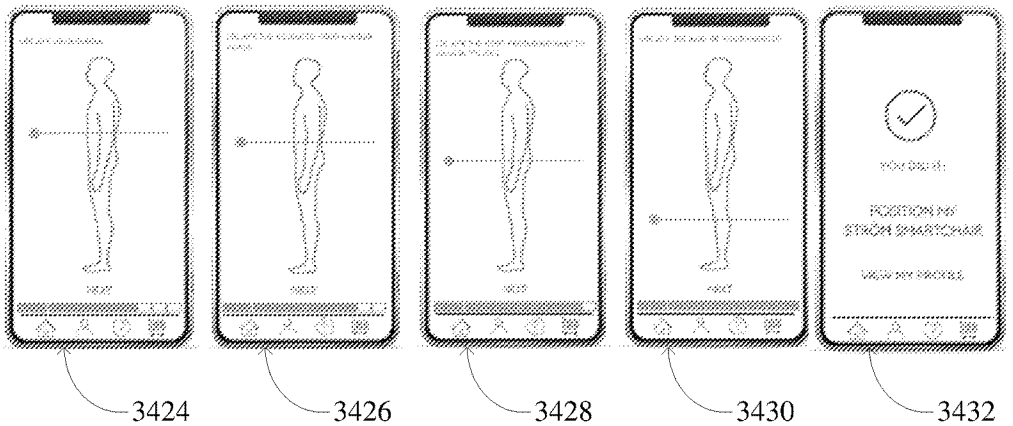
Figure 36:
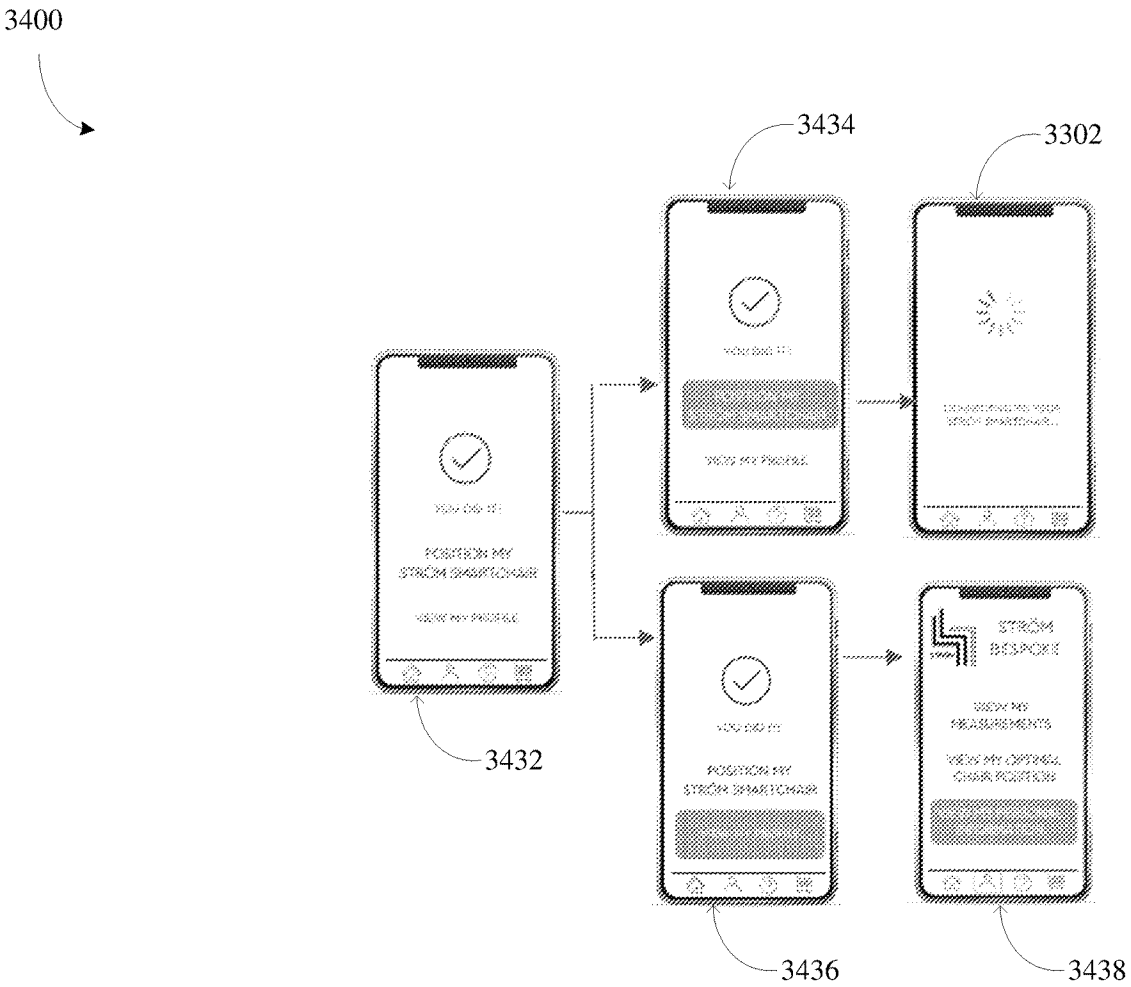

Workflow 3400 shown in FIGS. 34, 35, and 36 illustrates the software application process which occurs when the user chooses to measure his or her body at home screen 3208. In FIG. 34, the application displays introduction screen 3402, and then presents an optional tutorial (in screen 3404) on how the user's body is measured by the application. After the user is presented with the option of the tutorial, the application prompts the user to take full-body back view and side view photographs at screens 3406 and 3408, respectively. After the full-body photographs are completed, the application displays a success page (in screen 3410), and then proceeds to screens for obtaining body measurements and other personal data from the user. At screen 3412, the user is asked to select which sitting position the user is most comfortable in, the options being "neutral," "perch," or "recline." At screen 3414, the user is prompted to indicate the heel height of the user's footwear. At screen 3416, the application displays the full-body image of the user obtained from screen 3406. On screen 3416, the user is prompted to position two horizontal bars to indicate the top of the user's head in the image and the point at which the user's heels meet the floor. This information, together with the height information entered at screen 3206 in FIG. 32, enable the application to interpolate distances between points on the photograph. At screen 3418, the user is prompted to position two vertical lines indicating the widest part of the user's shoulders corresponding to the greatest distance between the user's right and left deltoid muscles. Similarly, at screen 3420 the application prompts the user to position two vertical lines indicating the widest part of the user's hips. Based on the positioning of the lines on screens 3418 and 3420, the application can calculate the distances by scaling the image with the user's known height at screen 3416.

At screen 3422 the application obtains the user's body measurements from the side-view image obtained at screen 1908. Continuing workflow 3400 in FIG. 35, the application prompts the user to again indicate the top of the user's head in the image and the point at which the user's heels meet the floor so that the application can interpolate distances between points on the photograph. At screen 3424, the application prompts the user to position a horizontal line indicating the location of the base of the user's elbow. Similarly, at screens 3426, 3428, and 3430, the application prompts the user to position a horizontal at the middle of the user's lumbar curve, at the most protruding part of the user's buttocks, and the at the base of the user's kneecap, respectively. The application signals successful completion of these steps with success screen 3432.

Continuing workflow 3400 in FIG. 36, from success screen 3432, the user can choose to position his or her programmable ergonomic chair (as shown in screen 3434) or to view the user's profile (as shown in screen 3436). From screen 3434, the application proceeds to screen 3302 of FIG. 33 in which the application attempts to discover the programmable ergonomic chair for positioning, and so on. Proceeding from screen 3436, the user is presented with a menu of view options at screen 3438: to view his or her measurements, to view the optimal chair positioning calculated by the application, or to view the user's personal information.

Figure 37:
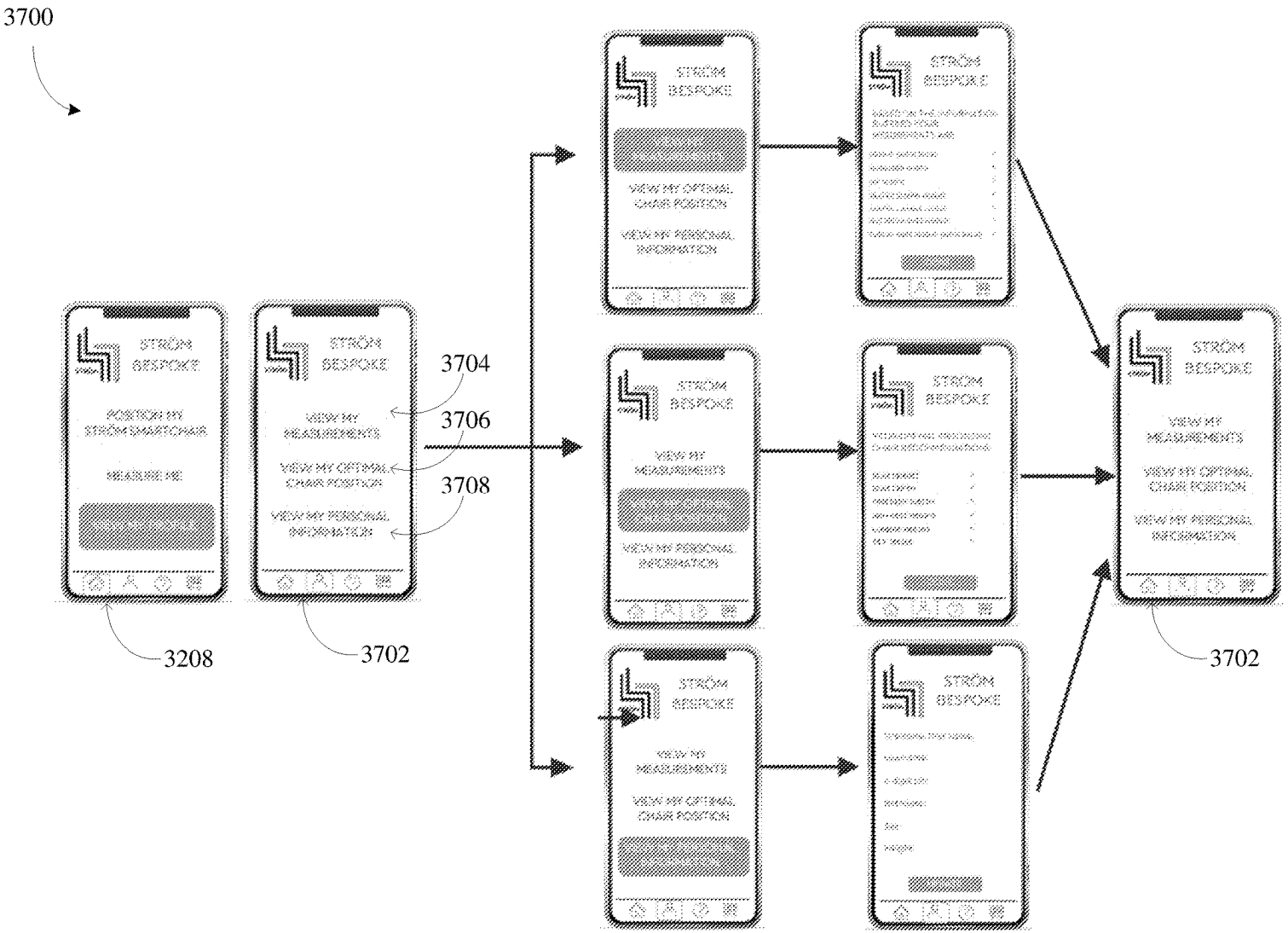

FIG. 37 illustrates workflow 3700 which occurs when the user selects to view his or her personal information or profile at the menu of view options at screen 3438 or at home screen 3208. At screen 3702, the user is prompted to choose from three different detailed view options. Option 3704 at screen 3702 presents the user with the user's body measurements calculated in workflow 3400. Option 3706 presents the user with the optimal ergonomic chair positions determined from the user's body measurements and other personal information. Option 3708 presents the user with the user's account information entered at account creation screen 3206. Completing any of these three options returns the user to screen 3702.

Figure 38:
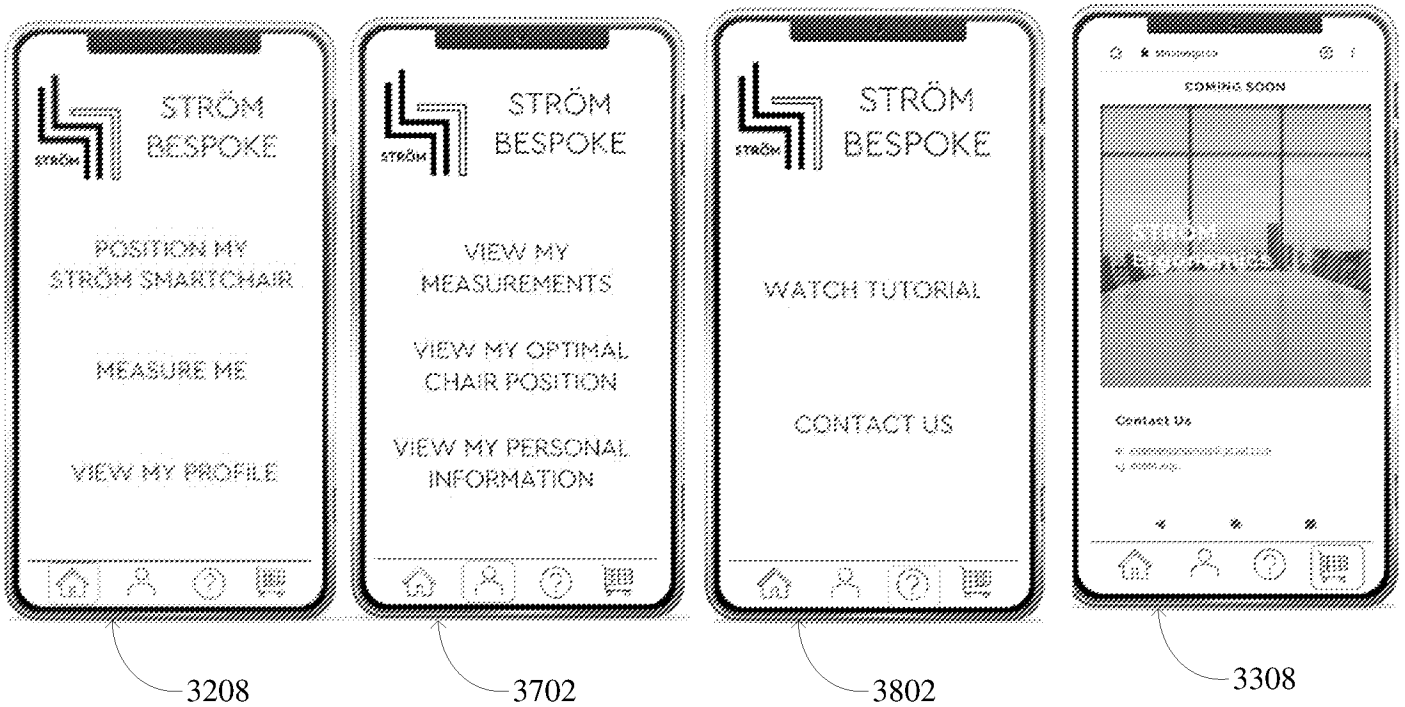
Figure 39:
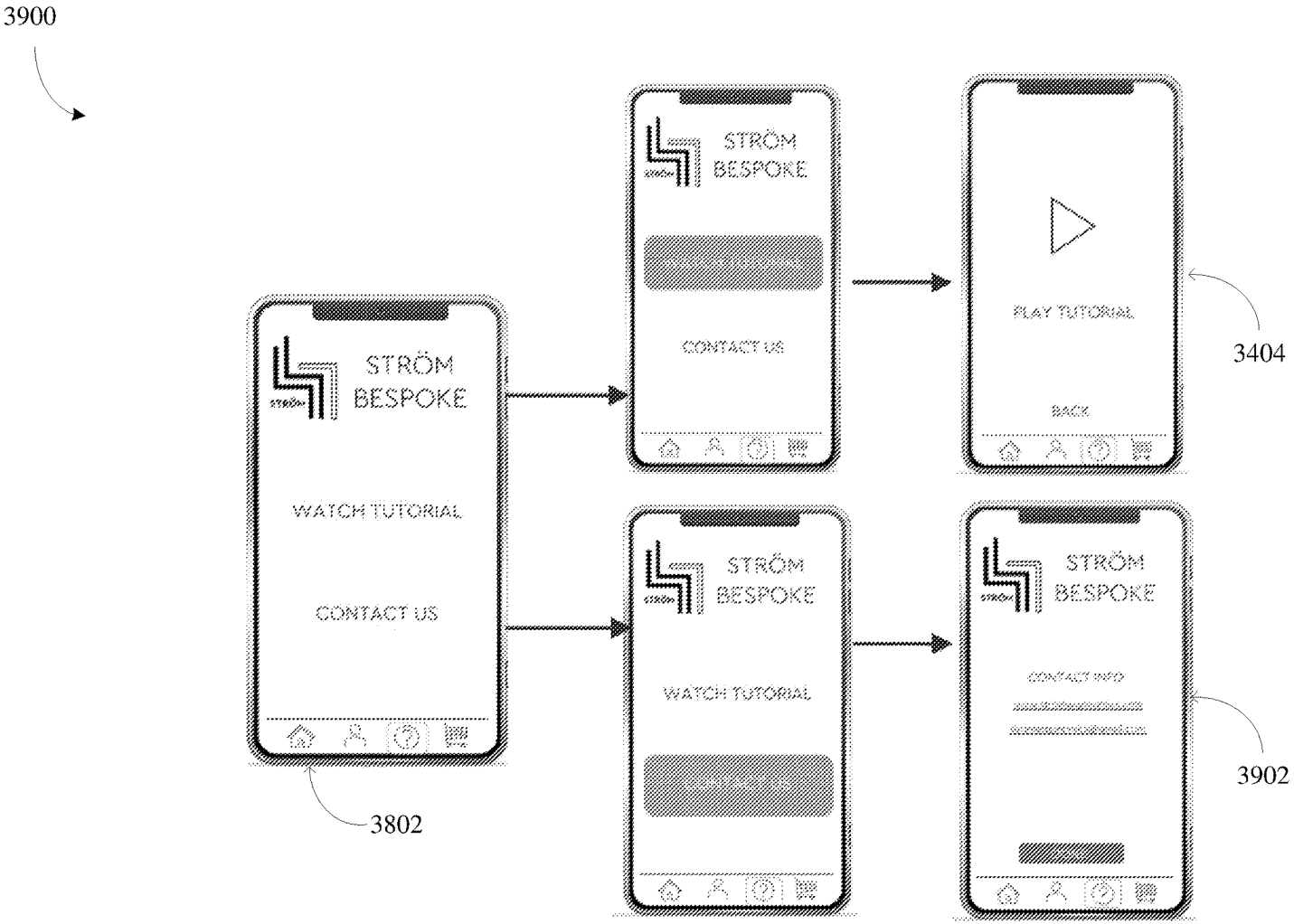

FIG. 38 illustrates the various menu options accessible from the menu bar on home page, including the home screen 3208, screen 3702, screen 3802 which presents menu choices to watch the measurement tutorial or to proceed to manufacturer website information screen 3308. FIG. 39 further illustrates workflow 3900 proceeding from screen 3802 where the user can choose to watch a measurement tutorial or to contact the manufacturer.

Figure 40:
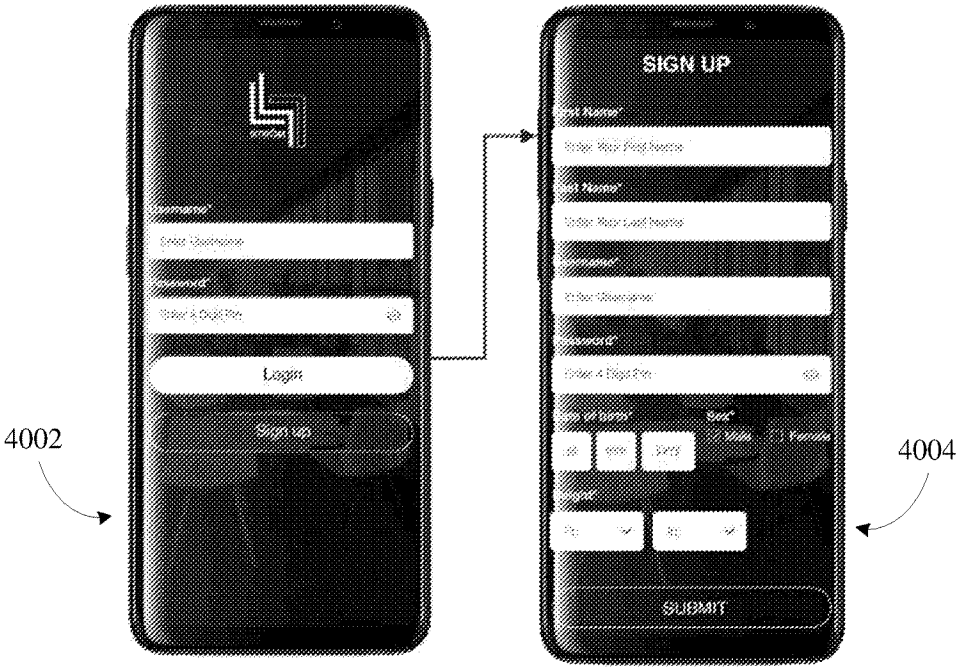
FIG. 40 illustrates login and account creation screens of a software application in an implementation.

FIG. 40 illustrates login and account creation screens of a software application in workflow 4000 in an implementation. In this implementation, when the application launches, the application presents the user with login screen 4002 with the options to login or to create a new account. If the user selects the option to create a new account, the application presents the user with account creation screen 4004 where the user provides personal data such as first and last name, an account username, a password, date of birth, sex, and the user's height.

Figure 41:
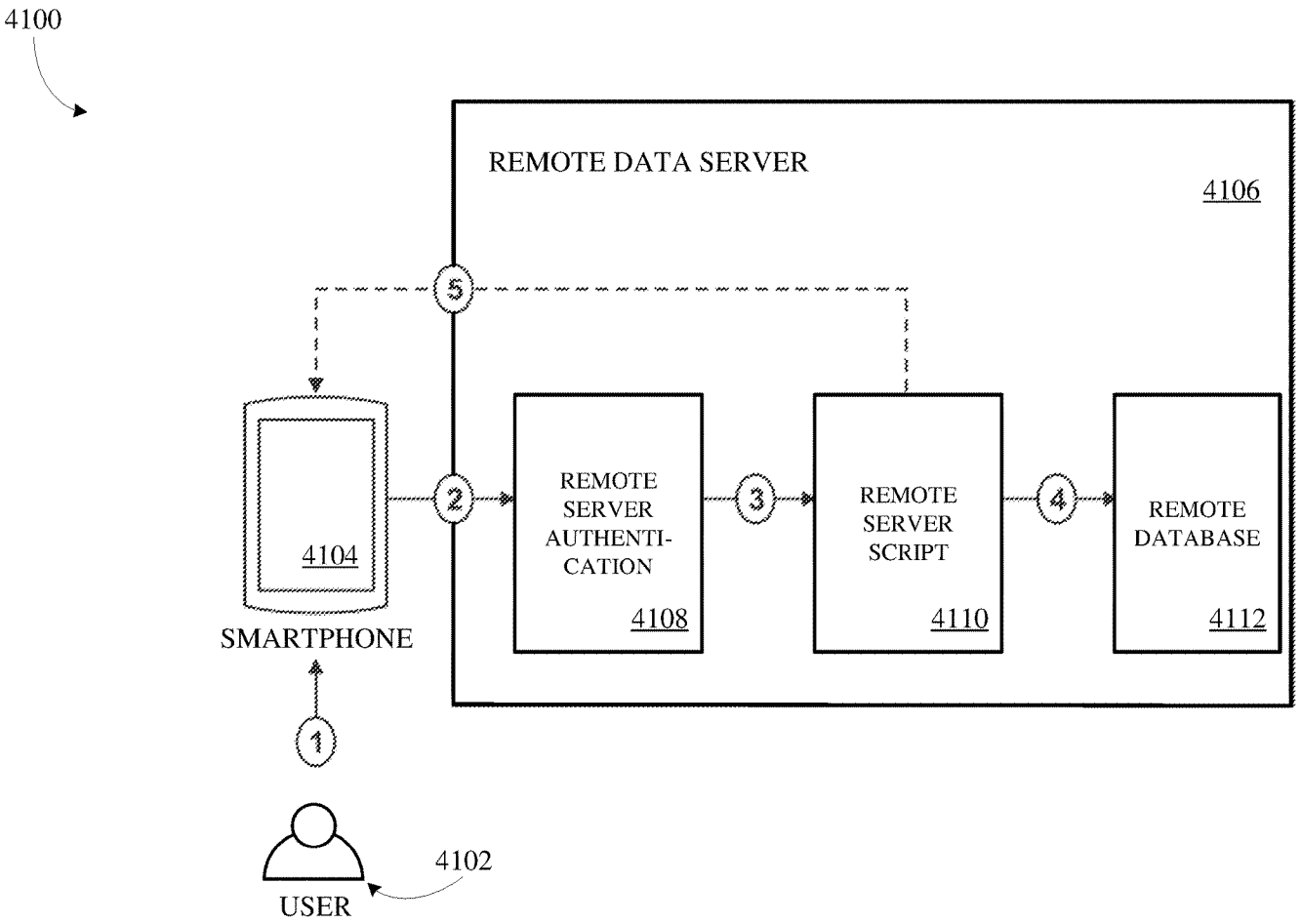
FIG. 41 illustrates a workflow of a system remote data server and database communication in an implementation.

FIG. 41 illustrates a flowchart of an implementation of a database communication system operating between remote data server 4106, remote database 4112 and smartphone 4104. In this implementation, a user 4102 launches a software application such as software application 412 of FIG. 30 on smartphone 4104 (step 1). The application connects to remote data server 4106 (step 2). Remote data server 4106 authenticates the user's credentials (step 3). When the authentication is complete, a connection is established between smartphone 4104 and remote database 4112. If user 4102 is creating an account, remote server script 4110 determines whether the username and password or personal identification number (PIN) already exist in remote database 4112. If the username and password or PIN do not exist, the user's credentials are then created and stored in remote database 4112. If user 4102 is logging into an existing account, remote server script 4110 verifies user 4102's login credentials and then allows the software application running on smartphone 4104 to access user 4102's information stored on remote database 4112. Remote data server 4106 will return a response to smartphone 4104 which will be processed by the software application (step 5). In an implementation, remote data server 4106 may be an AWS server system, and scripts running on remote data server 4106 may be implemented in PHP or another database programming language. Data stored on remote database 4112 may be accessible via SQL or another database management system.

Figure 42:
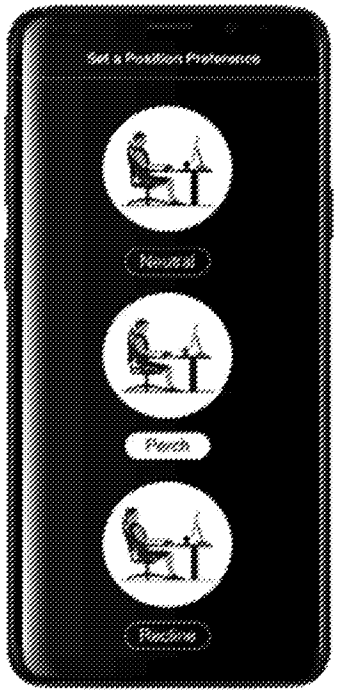
FIG. 42 illustrates a position preference screen in a software application in an implementation.

FIG. 42 illustrates an implementation of a position preference screen in a software application of which software application 412 in FIG. 30 is representative. The application prompts the user to select his or her preferred seating style or position preference from a menu of choices: neutral, perch, or recline. The application then uses the information to calculate the ergonomically optimal chair adjustments, such as seat tilt, of a programmable ergonomic chair of which chair 400 of FIG. 30 is representative.

Figure 43:
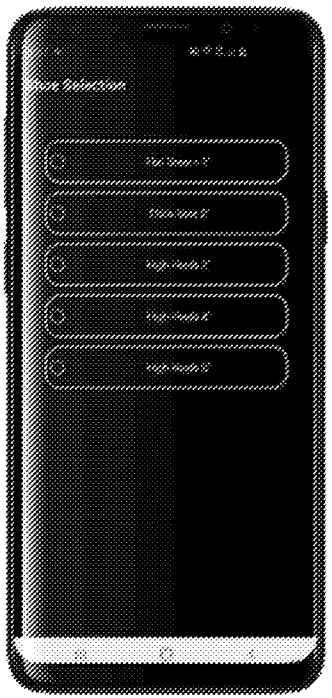
FIG. 43 illustrates a shoe selection screenshot in a software application in an implementation.

Similarly, FIG. 43 illustrates a shoe selection screen which may be implemented by the software application as it runs a process of which workflow 3400 is representative. In this screen, the application prompts the user to select the heel height of the user's footwear. In an implementation, this information is used by the software application in calculating ergonomically optimal chair adjustments, such as seat height, of the user's programmable ergonomic chair.

Figure 44:
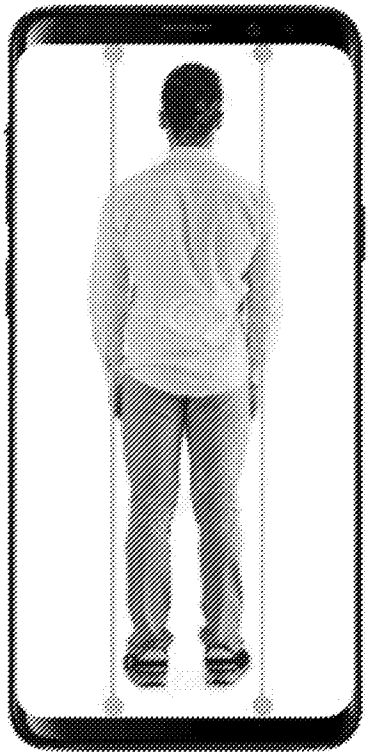

FIG. 44 illustrates an implementation of a body measurement screen displayed by a software application of which software application 412 in FIG. 30 is representative. The software application is executing workflow 3400 of FIGS. 34, 35, and 36 during which the user has used a camera on or connected to his mobile device to take a posterior view full-body photograph. This photograph is stored by the software application and optionally uploaded to remote data storage. The software application prompts the user to position two vertical lines superimposed on the photograph to mark the protrusions of the user's deltoid muscles. After the user has positioned the lines, the software application calculates the user's shoulder width by calculating the distance between the two lines based on scaling the photograph according to the user's height. In an alternative implementation, the photograph may comprise an anterior full-body view.

Figure 45:
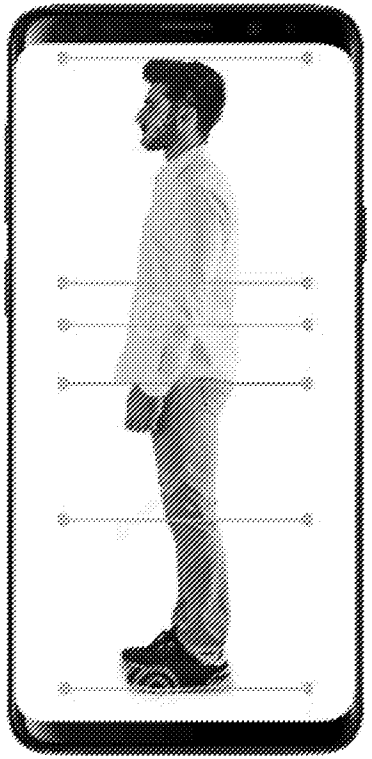
FIGS. 44-46 illustrate screenshots illustrating device screens for receiving user information in a software application in an implementation.

Similarly, FIG. 45 is an implementation of a body measurement screen displayed by the software application in which the application prompts the user to indicate on a lateral view full-body photograph the positions of various body landmarks. The user is presented with multiple horizontal lines superimposed on the photograph which the user positions by dragging to indicate the following landmarks: top of head, middle of elbow, middle of lumbar curve, most protruding part of buttocks, base of knee, and where the user's heel meets the floor. The software application calculates the distances between the various body landmarks by scaling distances on the photograph according to the user's known height and the lines marking the top of the user's head and where the user's heel meets the floor.

Figure 46:
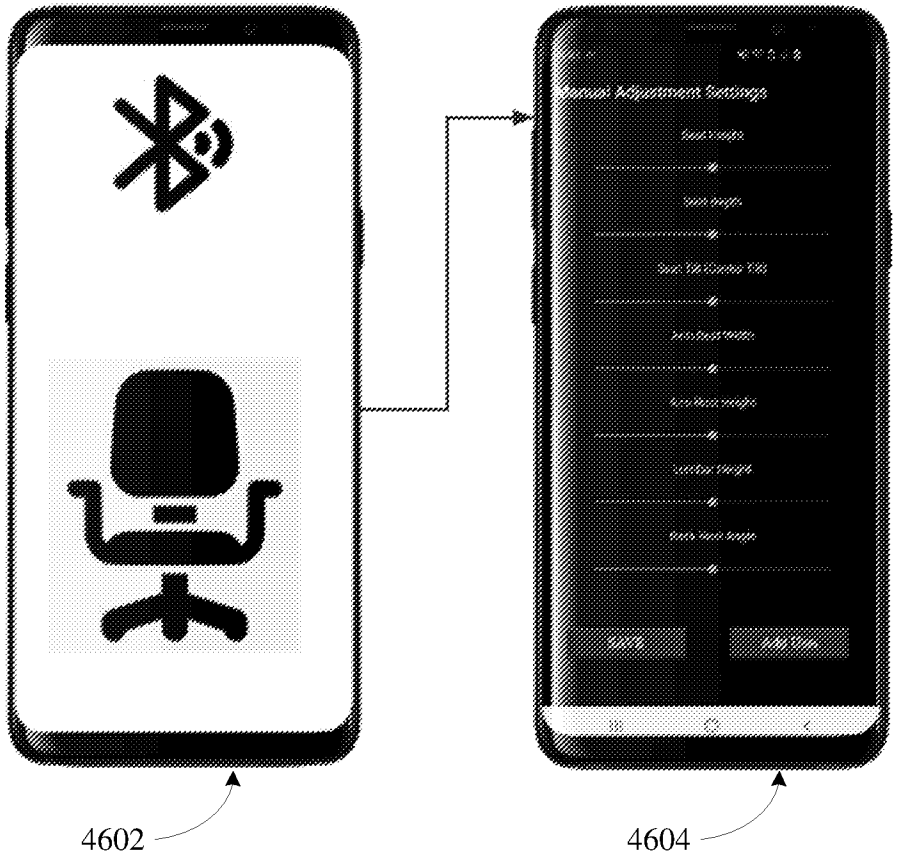

FIG. 46 illustrates implementations of Bluetooth® transmission screen 4602 and settings screen 4604 displayed by a software application running on a mobile device, of which software application 412 running on mobile device 410 is representative. In Bluetooth® transmission screen 4602, the software application searches for a discoverable programmable ergonomic chair to which it will communicate chair settings and, optionally, receive chair status information such as battery charge level or adjustment settings. The application will detect whether the Bluetooth® capability of the mobile device is on or off and will prompt the user to turn on the Bluetooth® capability if necessary. The application will then search for any discoverable programmable ergonomic chairs in the vicinity of the mobile device. Once a programmable ergonomic chair has been found, the mobile device will connect to the chair's Bluetooth® device.

After establishing a wireless connection with the chair, the software application will display settings screen 4604 where the user is presented with the chair position adjustments available for the chair. In an implementation of a programmable ergonomic chair with seat adjustment assembly 200 in FIG. 15, the chair has seven adjustments: seat height, seat depth, seat tilt, armrest width, armrest height, lumbar (backrest) height, and backrest angle. In an implementation of a chair with seat adjustment assembly 300 in FIG. 20, the programmable ergonomic chair also has an adjustment corresponding to lumbar support density or firmness, as shown in settings screen 3310 of FIG. 33. On settings screen 4604, the user may use slider objects displayed on the mobile device screen to modify the chair adjustment settings which were calculated according to his or her body measurements. In addition to adjusting chair settings, the user has the option to add other users by creating new logins and storing the data and profiles of other users.

The personal user information obtained in implementations such as those shown in FIGS. 42-46 as well as other information obtained from the user in the various other workflows may be stored by the application on local data storage of the mobile device. It may also be stored in remote data storage where the application may retrieve it for later use or analysis.

Figure 47:
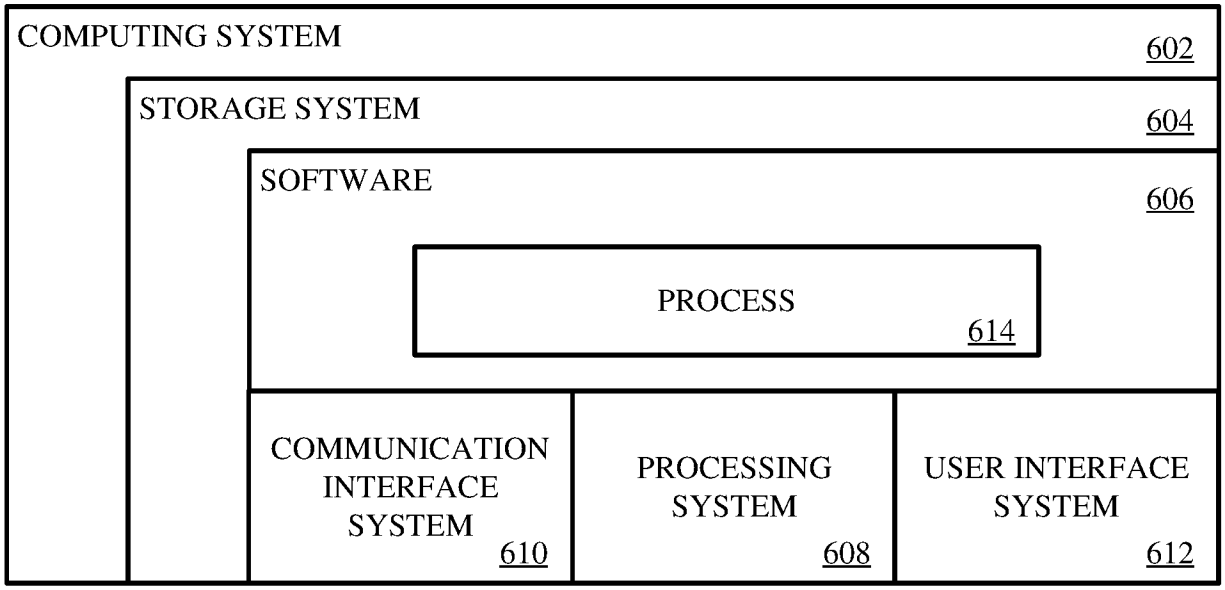
FIG. 47 illustrates a computing system suitable for implementing the various operational environments, architectures, processes, scenarios, and sequences discussed below with respect to the other Figures.

FIG. 47 illustrates computing device 602 which is representative of any system or collection of systems in which the various processes, programs, services, and scenarios disclosed herein may be implemented. Examples of computing device 602 include, but are not limited to, desktop and laptop computers, tablet computers, mobile computers, and wearable devices. Examples may also include server computers, web servers, cloud computing platforms, and data center equipment, as well as any other type of physical or virtual server machine, container, and any variation or combination thereof.

Computing device 602 may be implemented as a single apparatus, system, or device or may be implemented in a distributed manner as multiple apparatuses, systems, or devices. Computing device 602 includes, but is not limited to, storage system 604, software 606, processing system 608, communication interface system 610, and user interface system 612. Processing system 608 is operatively coupled with storage system 604, communication interface system 610, and user interface system 612.

Processing system 608 loads and executes software 606 from storage system 604. Software 606 includes and implements process 614 which is representative of processes and workflows discussed in the preceding Figures, such as processes and workflows 500, 3200, 3300, 3400, 3700, 3900, 4000, or 4100. When executed by processing system 608, software 606 directs processing system 608 to operate as described herein for at least the various processes, operational scenarios, and sequences discussed in the foregoing implementations. Computing device 602 may optionally include additional devices, features, or functionality not discussed for purposes of brevity.

Referring still to FIG. 47, processing system 608 may comprise a microprocessor and other circuitry that retrieves and executes software 606 from storage system 604. Processing system 608 may be implemented within a single processing device but may also be distributed across multiple processing devices or sub-systems that cooperate in executing program instructions. Examples of processing system 608 include general purpose central processing units, graphical processing units, application specific processors, and logic devices, as well as any other type of processing device, combinations, or variations thereof.

Storage system 604 may comprise any computer readable storage media readable by processing system 608 and capable of storing software 606. Storage system 604 may include volatile and nonvolatile, removable and non-removable media implemented in any method or technology for storage of information, such as computer readable instructions, data structures, program modules, or other data. Examples of storage media include random access memory, read-only memory, magnetic disks, optical disks, flash memory, virtual memory and non-virtual memory, magnetic cassettes, magnetic tape, magnetic disk storage or other magnetic storage devices, or any other suitable storage media. In no case is the computer readable storage media a propagated signal.

In addition to computer readable storage media, in some implementations storage system 604 may also include computer readable communication media over which at least some of software 606 may be communicated internally or externally. Storage system 604 may be implemented as a single storage device but may also be implemented across multiple storage devices or sub-systems co-located or distributed relative to each other. Storage system 604 may comprise additional elements, such as a controller, capable of communicating with processing system 608 or possibly other systems.

Software 606 (including process 614) may be implemented in program instructions and among other functions may, when executed by processing system 608, direct processing system 608 to operate as described with respect to the various operational scenarios, sequences, and processes illustrated herein. For example, software 606 may include program instructions for implementing a programmable ergonomic chair application as described herein.

In particular, the program instructions may include various components or modules that cooperate or otherwise interact to carry out the various processes and operational scenarios described herein. The various components or modules may be embodied in compiled or interpreted instructions, or in some other variation of combination of instructions. The various components or modules may be executed in a synchronous or asynchronous manner, serially or in parallel, in a single threaded environment or multi-threaded, or in accordance with any other suitable execution paradigm, variation or combination thereof. Software 606 may include additional processes, programs, or components, such as operating system software, virtualization software, or other application software. Software 606 may also comprise firmware or some other form of machine-readable processing instructions executable by processing system 608.

In general, software 606 may, when loaded into processing system 608 and executed, transform a suitable apparatus, system, or device (of which computing device 602 is representative) overall from a general-purpose computing system into a special-purpose computing system customized to support remotely adjusting a programmable ergonomic chair in an optimized manner. Indeed, encoding software 606 on storage system 604 may transform the physical structure of storage system 604. The specific transformation of the physical structure may depend on various factors in different implementations of this description. Examples of such factors may include, but are not limited to, the technology used to implement the storage media of storage system 604 and whether the computer-storage media are characterized as primary or secondary storage, as well as other factors.

For example, if the computer readable storage media are implemented as semiconductor-based memory, software 606 may transform the physical state of the semiconductor memory when the program instructions are encoded therein, such as by transforming the state of transistors, capacitors, or other discrete circuit elements constituting the semiconductor memory. A similar transformation may occur with respect to magnetic or optical media. Other transformations of physical media are possible without departing from the scope of the present description, with the foregoing examples provided only to facilitate the present discussion.

Communication interface system 610 may include communication connections and devices that allow for communication with other computing systems (not shown) over communications networks (not shown). Examples of connections and devices that together allow for inter-system communication may include network interface cards, antennas, power amplifiers, RF circuitry, transceivers, and other communication circuitry. The connections and devices may communicate over communication media to exchange communications with other computing systems or networks of systems, such as metal, glass, air, or any other suitable communication media. The aforementioned media, connections, and devices are well known and need not be discussed at length here.

Communication between computing device 602 and other computing systems (not shown) may occur over a communication network or networks and in accordance with various communication protocols, combinations of protocols, or variations thereof. Examples include intranets, internets, the Internet, local area networks, wide area networks, wireless networks, wired networks, virtual networks, software defined networks, data center buses and backplanes, or any other type of network, combination of network, or variation thereof. The aforementioned communication networks and protocols are well known and need not be discussed at length here.

As will be appreciated by one skilled in the art, aspects of the present technology may be embodied as a system, method, or computer program product. Accordingly, aspects of the present technology may take the form of an entirely hardware embodiment, an entirely software embodiment (including firmware, resident software, micro-code, etc.) or an embodiment combining software and hardware aspects that may all generally be referred to herein as a "circuit, "module," or "system." Furthermore, aspects of the present technology may take the form of a computer program product embodied in one or more computer readable medium(s) having computer readable program code embodied thereon.

It may be appreciated that, while the inventive concepts disclosed herein are discussed in the context of software applications which remotely adjusting ergonomic furniture, they apply as well to other contexts such as automotive control system software. Likewise, the concepts apply not just to ergonomic office or task chairs, but to other types of workplace furniture such as desks, tables, work surfaces, and other types of seating.

Indeed, the included descriptions and figures depict specific embodiments to teach those skilled in the art how to make and use the best mode. For the purpose of teaching inventive principles, some conventional aspects have been simplified or omitted. Those skilled in the art will appreciate variations from these implementations that fall within the scope of the disclosure. Those skilled in the art will also appreciate that the features described above may be combined in various ways to form multiple implementations. As a result, the technology is not limited to the specific implementations described above, but only by the claims and their equivalents.

Thus, the objects of the technology are efficiently obtained, although it should be apparent that alternative implementations of the technology are possible and intended to be within the scope of the appended claims. The software listing on pages 22-36 and chair macro and micro parameter tables on pages 37-40 of U.S. Provisional Patent Application No. 63/127,733 are herein incorporated by reference. The software listing and parameter tables reflect an implementation of the code necessary to run the mobile device application.

The technical effect of the technology presented herein is to bridge the gap between the user's inability to configure his or her adjustable chair in an ergonomically optimal way and obtaining for the user an ergonomically optimally adjusted chair. The technology presented herein bridges that gap by providing a complete solution, including the steps of measuring the height of a person, calculating the optimal ergonomic chair settings based on the body measurements and other physical characteristics of the user, transmitting the adjustments to a controller in the chair, and performing the adjustments through systems of motorized actuators to obtain the optimum ergonomic adjustment for the user.

The art is replete with adjustable task chairs which are intended to simplify the use of adjustable chairs. For example, U.S. Pat. No. 6,964,370 (Hagele et al.) discloses a smart office chair that includes actuators that adjust the seat back, the seat base and the armrests using various actuators. The chair communicates with a user via RFID technology to automatically adjust itself to preset parameters. The chair is also configured to communicate with other furniture via RFID. For example, the RFID reader/controller of the chair may determine that the chair is within a predetermined proximity of a smart desk and then adjust the chair to coordinate with the desk. Although this patented chair is highly adjustable, there is no teaching in the patent that the adjustments communicated to the chair are based on ergonomic factors determined based upon a particular user's physical characteristics. There is no teaching that the chair is adjusted for the user to achieve optimum ergonomic adjustments and locations of all adjustable chair components for that particular person's physiological characteristics. The "profile" described in this patent is not an optimum ergonomic orientation of the chair, but instead a set of user-defined settings.

U.S. Pat. No. 9,247,828 (Cvek) discloses a smart seating chair with IC controls, electronic sensors, and wired and wireless data and power transfer capabilities. The chair is operatively arranged to communicate wirelessly or by wire with an external computing device to adjust configuration parameters. Although this patented chair is highly adjustable, there is no teaching in the patent that the adjustments communicated to the chair are based on ergonomic factors determined based upon a particular user's physical characteristics. There is no teaching that the chair is adjusted for the user to achieve optimum ergonomic adjustments and locations of all adjustable chair components for that particular person's physiological characteristics.

U.S. Pat. No. 9,622,581 (Cvek) discloses a mobile task chair and mobile task chair control mechanism with adjustment capabilities and visual setting indicators. Cvek also discloses wireless smart phone connectivity, or connectivity to any other computing device running a dedicated task chair control and setting indication application program. The user can match the suggested setting or choose his or her own setting to configure the chair control mechanism. Although this patented chair is highly adjustable, there is no teaching in the patent that the adjustments communicated to the chair are based on ergonomic factors determined based upon a particular user's physical characteristics. There is no teaching that the chair is adjusted for the user to achieve optimum ergonomic adjustments and locations of all adjustable chair components for that particular person's physiological characteristics.

U.S. Published Patent Application No. 2018/0199729 (Bullard et al.) disclose an automatically adjusting comfort system operatively arranged to adjust the comfort system's position based on feedback communicated from a plurality of sensors. The comfort system comprises a seat bottom, a seat back, a lumbar support, a sensor array, position motors, air bladders, massagers, and thermal pads. Bullard et al. disclose a posture score determined by a weighted pressure profile collected from the plurality of sensors. The weighted pressure profile is determined by a processor that executes a software operatively arranged to calculate a posture score to establish thresholds to determine if the position motors need to actuate their positions. Additionally, Bullard et al. disclose custom algorithms for individual users to accommodate the weight of the user, a particular sensitivity of the user, e.g., a susceptibility to poor posture, or a personal preference. Despite these functional characteristics of the underlying invention, there is no teaching in the patent application that the adjustments communicated to the chair are based on ergonomic factors determined based upon a particular user's height and other physical characteristics (other than perhaps weight). There is no teaching that the chair is adjusted for the user to achieve optimum ergonomic adjustments and locations of all adjustable chair components for that particular person's physiological characteristics. There is no teaching of a user taking a photograph of himself or herself, entering one dimension (height) and then manipulating tools on a mobile device to interpolate or otherwise estimate other personal body characteristics and dimensions.

It may be appreciated that, pertaining to the Figures discussed above, like drawing numbers on different drawing views identify identical, or functionally similar, structural elements. It may be further appreciated that the claims are not limited to the disclosed aspects.

Furthermore, it is understood that this disclosure is not limited to the particular methodology, materials and modifications described and as such may, of course, vary. It is also understood that the terminology used herein is for the purpose of describing particular aspects only and is not intended to limit the scope of the claims.

Unless defined otherwise, all technical and scientific terms used herein have the same meaning as commonly understood to one of ordinary skill in the art to which this disclosure pertains. It may be appreciated that any methods, devices, or materials similar or equivalent to those described herein can be used in the practice or testing of the example implementations.

It may be appreciated that the term "substantially" is synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims.

What is claimed is:

1. A remotely adjustable ergonomic chair, comprising:

an adjustable chair having a controller operatively arranged to control a plurality of actuators in said chair;

a mobile device operatively arranged to communicate with said controller;

wherein said mobile device includes a software application configured to enable a user to take various photographs of the user for storage and analysis in said mobile device;

wherein said software application is arranged to permit said user to graphically represent personal body measurements within said photographs displayed on said mobile device, and to input and store the height of the user;

wherein said software application is arranged to calculate a plurality of personal body dimensions by analyzing the size and number of pixels in said photographs in view of said known height of said user;

wherein said software application is operatively arranged to calculate ergonomically optimum adjustments for said chair based upon factors selected from the group consisting of ergonomics, human factors, physiology, anatomy, biomechanics, anthropometry, and kinesiology;

first communication means operatively arranged to communicate said ergonomically optimum adjustments to said controller to adjust said chair.

2. The remotely adjustable ergonomic chair recited in claim 1, further comprising a central server containing a computer storage device operatively arranged to store optimal ergonomic data for office chairs, said server in communication with said mobile device, wherein said server is arranged to transmit updated optimal ergonomic data to said mobile device.

3. The remotely adjustable ergonomic chair recited in claim 1, wherein said plurality of actuators are operatively arranged to control adjustments of one or more of the following: seat height, seat depth, seat tilt, armrest width, armrest height, lumbar height, lumbar support density, and backrest angle.

4. The remotely adjustable ergonomic chair recited in claim 1 wherein personal body rear view measurements, taken when the user is standing with arms outstretched at the user's side with palms open, are selected from the group consisting of the height of the user, the width of the user's hips, and the approximate distance between the left and right deltoid muscles of the user.

5. The remotely adjustable ergonomic chair recited in claim 1 wherein said personal body side view measurements, taken when the user is standing with arms outstretched at the user's side with palms open, are selected from the group consisting of the distance from the top of the user's head to the middle of the user's elbow, the top of the user's head to the middle of the user's lumbar curve, the distance from the top of the user's head to the most protruding part of the user's buttocks, and the distance from the top of the user's head to the approximate base of the user's patella.

6. The remotely adjustable ergonomic chair recited in claim 1, wherein said chair comprises:

an adjustable armrest;

an adjustable backrest;

a central actuator further comprising:

a motor; and, a ball-shift gearbox operatively arranged to toggle a plurality of ball couplers and coupling gears;

a primary screw shaft and a secondary screw shaft;

a plurality of secondary actuators;

a wirelessly enabled controller operatively arranged to convey commands from an external device to said central actuator or to said plurality of secondary actuators; and, a power supply operatively arranged to power said motor.

7. The remotely adjustable ergonomic chair recited in claim 6 wherein said power supply is a battery removably secured to said chair.

8. The remotely adjustable ergonomic chair recited in claim 6 wherein said external device is a computer.

9. The remotely adjustable ergonomic chair recited in claim 6 wherein said external device is a mobile device.

10. A remotely adjustable ergonomic chair, comprising:

a seat fixedly secured to an adjustable base;

an adjustable armrest;

an adjustable backrest;

a central actuator further comprising:

a motor; and, a ball-shift gearbox operatively arranged to toggle a plurality of ball couplers and coupling gears;

a primary screw shaft and a secondary screw shaft;

a plurality of secondary actuators;

a wirelessly enabled controller operatively arranged to convey commands from an external computer to said central actuator or to said plurality of secondary actuators; and, a power supply operatively arranged to power said motor.

11. The remotely adjustable ergonomic chair recited in claim 10 wherein said adjustable base is operatively arranged to actuate in response to activation of at least one said ball coupler to engage at least said secondary screw shaft or said primary screw shaft and said secondary screw shaft simultaneously.

12. The remotely adjustable ergonomic chair recited in claim 11 wherein said adjustable armrest is operatively arranged to actuate in response to activation of at least one said ball coupler or at least one of said plurality of secondary actuators.

13. The remotely adjustable ergonomic chair recited in claim 12 wherein said adjustable backrest is operatively arranged to actuate in response to at least one of said plurality of secondary actuators.

14. The remotely adjustable ergonomic chair recited in claim 10 wherein said seat is operatively arranged to be adjustable in depth, height, and tilt.

15. The remotely adjustable ergonomic chair recited in claim 10 wherein said adjustable armrest is operatively arranged to be adjustable in height and width.

16. The remotely adjustable ergonomic chair recited in claim 10 wherein said adjustable backrest is operatively arranged to be adjustable in height, angle, and lumbar support density.

* * * * *